US007566386B2

(12) United States Patent
Wilson et al.

(10) Patent No.: US 7,566,386 B2
(45) **Date of Patent: *Jul. 28, 2009**

(54) SYSTEM FOR ELECTROCHEMICALLY PROCESSING A WORKPIECE

(75) Inventors: Gregory J. Wilson, Kalispell, MT (US); Paul R. McHugh, Kalispell, MT (US); Kyle M. Hanson, Kalispell, MT (US)

(73) Assignee: Semitool, Inc., Kalispell, MT (US)

( * ) Notice: Subject to any disclaimer, the term of this patent is extended or adjusted under 35 U.S.C. 154(b) by 915 days.

This patent is subject to a terminal disclaimer.

(21) Appl. No.: 10/975,154

(22) Filed: Oct. 28, 2004

(65) Prior Publication Data

US 2005/0109628 A1 May 26, 2005

Related U.S. Application Data

(63) Continuation of application No. 10/715,700, filed on Nov. 18, 2003, now abandoned, which is a continuation of application No. 09/804,697, filed on Mar. 12, 2001, now Pat. No. 6,660,137, which is a continuation of application No. PCT/US00/10120, filed on Apr. 13, 2000.

(60) Provisional application No. 60/129,055, filed on Apr. 13, 1999, provisional application No. 60/143,769, filed on Jul. 12, 1999, provisional application No. 60/182,160, filed on Feb. 14, 2000.

(51) Int. Cl.
*C25D 17/02* (2006.01)
*C25F 7/00* (2006.01)
*C25D 7/12* (2006.01)

(52) U.S. Cl. ..... 204/230.7; 204/232; 204/252; 204/260

(58) Field of Classification Search ..... None
See application file for complete search history.

(56) References Cited

U.S. PATENT DOCUMENTS 1,255,395 A 2/1918 Duran (Continued)

FOREIGN PATENT DOCUMENTS

CA 873651 6/1971

(Continued)

OTHER PUBLICATIONS

International Search Report for International Application No. PCT/US01/21579 mailed Nov. 16, 2001; Applicant: Semitool, Inc. 3 pgs.

(Continued)

*Primary Examiner*—Harry D Wilkins, III
(74) *Attorney, Agent, or Firm*—Perkins Coie LLP; Kenneth H. Ohriner; Craig E. Bohn

(57) ABSTRACT

A reactor for electrochemically processing at least one surface of a microelectronic workpiece is set forth. The reactor comprises a reactor head including a workpiece support that has one or more electrical contacts positioned to make electrical contact with the microelectronic workpiece. The reactor also includes a processing container having a plurality of nozzles angularly disposed in a sidewall of a principal fluid flow chamber at a level within the principal fluid flow chamber below a surface of a bath of processing fluid normally contained therein during electrochemical processing. A plurality of anodes are disposed at different elevations in the principal fluid flow chamber so as to place them at difference distances from a microelectronic workpiece under process without an intermediate diffuser between the plurality of anodes and the microelectronic workpiece under process. One or more of the plurality of anodes may be in close proximity to the workpiece under process. Still further, one or more of the plurality of anodes may be a virtual anode. The present invention also related to multi-level anode configurations within a principal fluid flow chamber and methods of using the same.

26 Claims, 15 Drawing Sheets

U.S. PATENT DOCUMENTS

| | | | | |
|---|---|---|---|---|
| 1,526,644 | A | | 2/1925 | Pinney |
| 1,881,713 | A | | 10/1932 | Laukel |
| 2,256,274 | A | | 9/1941 | Boedecker et al. |
| 3,309,263 | A | | 3/1967 | Grobe |
| 3,616,284 | A | | 10/1971 | Bodmer et al. |
| 3,664,933 | A | | 5/1972 | Clauss |
| 3,706,635 | A | | 12/1972 | Kowalski |
| 3,706,651 | A | | 12/1972 | Leland |
| 3,716,462 | A | | 2/1973 | Jensen |
| 3,727,620 | A | | 4/1973 | Orr |
| 3,798,003 | A | | 3/1974 | Ensley et al. |
| 3,798,033 | A | | 3/1974 | Yost, Jr. |
| 3,878,066 | A | | 4/1975 | Dettke et al. |
| 3,880,725 | A | * | 4/1975 | Van Raalte et al. ..... 205/95 |
| 3,930,963 | A | | 1/1976 | Polichette et al. |
| 3,953,265 | A | | 4/1976 | Hood |
| 3,968,885 | A | | 7/1976 | Hassan et al. |
| 4,000,046 | A | | 12/1976 | Weaver |
| 4,022,679 | A | | 5/1977 | Koziol et al. |
| 4,030,015 | A | | 6/1977 | Herko et al. |
| 4,046,105 | A | | 9/1977 | Gomez |
| 4,072,557 | A | | 2/1978 | Schiel |
| 4,082,638 | A | | 4/1978 | Jumer |
| 4,113,577 | A | | 9/1978 | Ross et al. |
| 4,132,567 | A | | 1/1979 | Blackwood |
| 4,134,802 | A | | 1/1979 | Herr |
| 4,137,867 | A | | 2/1979 | Aigo |
| 4,165,252 | A | | 8/1979 | Gibbs |
| 4,170,959 | A | | 10/1979 | Aigo |
| 4,222,834 | A | | 9/1980 | Bacon et al. |
| 4,238,310 | A | | 12/1980 | Eckler et al. |
| 4,246,088 | A | | 1/1981 | Murphy et al. |
| 4,259,166 | A | | 3/1981 | Whitehurst |
| 4,276,855 | A | | 7/1981 | Seddon |
| 4,286,541 | A | | 9/1981 | Blackwood |
| 4,287,029 | A | | 9/1981 | Shimamura |
| 4,304,641 | A | | 12/1981 | Grandia et al. |
| 4,323,433 | A | | 4/1982 | Loch |
| 4,341,629 | A | | 7/1982 | Uhlinger |
| 4,360,410 | A | | 11/1982 | Fletcher et al. |
| 4,378,283 | A | | 3/1983 | Seyffert |
| 4,384,930 | A | | 5/1983 | Eckles |
| 4,391,694 | A | | 7/1983 | Runsten |
| 4,422,915 | A | | 12/1983 | Wielonski et al. |
| 4,431,361 | A | | 2/1984 | Bayne |
| 4,437,943 | A | | 3/1984 | Beck |
| 4,439,243 | A | | 3/1984 | Titus |
| 4,439,244 | A | | 3/1984 | Allevato |
| 4,440,597 | A | | 4/1984 | Wells et al. |
| 4,443,117 | A | | 4/1984 | Muramoto et al. |
| 4,449,885 | A | | 5/1984 | Hertel |
| 4,451,197 | A | | 5/1984 | Lange |
| 4,463,503 | A | | 8/1984 | Applegate |
| 4,466,864 | A | | 8/1984 | Bacon |
| 4,469,566 | A | | 9/1984 | Wray |
| 4,475,823 | A | | 10/1984 | Stone |
| 4,480,028 | A | | 10/1984 | Kato et al. |
| 4,495,153 | A | | 1/1985 | Midorikawa |
| 4,495,453 | A | | 1/1985 | Inaba |
| 4,500,394 | A | | 2/1985 | Rizzo |
| 4,529,480 | A | | 7/1985 | Trokhan |
| 4,541,895 | A | | 9/1985 | Albert |
| 4,544,446 | A | | 10/1985 | Cady |
| 4,566,847 | A | | 1/1986 | Maeda |
| 4,576,685 | A | | 3/1986 | Goffredo et al. |
| 4,576,689 | A | | 3/1986 | Makkaev |
| 4,585,539 | A | | 4/1986 | Edson |
| 4,600,463 | A | | 7/1986 | Aigo |
| 4,604,177 | A | | 8/1986 | Sivilotti |
| 4,604,178 | A | | 8/1986 | Fiegener |
| 4,634,503 | A | | 1/1987 | Nogavich |
| 4,639,028 | A | | 1/1987 | Olson |
| 4,648,944 | A | | 3/1987 | George |
| 4,664,133 | A | | 5/1987 | Silvernail |
| 4,670,126 | A | | 6/1987 | Messer et al. |
| 4,685,414 | A | | 8/1987 | DiRico |
| 4,687,552 | A | | 8/1987 | Early et al. |
| 4,693,017 | A | | 9/1987 | Oehler et al. |
| 4,696,729 | A | | 9/1987 | Santini |
| 4,715,934 | A | | 12/1987 | Tamminen |
| 4,732,785 | A | | 3/1988 | Brewer |
| 4,741,624 | A | | 5/1988 | Barroyer |
| 4,750,505 | A | | 6/1988 | Inuta |
| 4,760,671 | A | | 8/1988 | Ward |
| 4,761,214 | A | | 8/1988 | Hinman |
| 4,770,590 | A | | 9/1988 | Hugues et al. |
| 4,773,436 | A | | 9/1988 | Cantrell et al. |
| 4,781,800 | A | | 11/1988 | Goldman |
| 4,790,262 | A | | 12/1988 | Nakayama |
| 4,800,818 | A | | 1/1989 | Kawaguchi et al. |
| 4,824,538 | A | | 4/1989 | Hibino et al. |
| 4,828,654 | A | | 5/1989 | Reed |
| 4,838,289 | A | | 6/1989 | Kottman |
| 4,849,054 | A | | 7/1989 | Klowak |
| 4,858,539 | A | | 8/1989 | Schumann |
| 4,864,239 | A | | 9/1989 | Casarcia et al. |
| 4,868,992 | A | | 9/1989 | Crafts et al. |
| 4,898,647 | A | | 2/1990 | Luce et al. |
| 4,902,398 | A | | 2/1990 | Homstad |
| 4,903,717 | A | | 2/1990 | Sumnitsch |
| 4,906,341 | A | | 3/1990 | Yamakawa |
| 4,911,818 | A | | 3/1990 | Kikuchi et al. |
| 4,913,085 | A | | 4/1990 | Vohringer et al. |
| 4,924,890 | A | | 5/1990 | Giles et al. |
| 4,944,650 | A | | 7/1990 | Matsumoto |
| 4,949,671 | A | | 8/1990 | Davis |
| 4,951,601 | A | | 8/1990 | Maydan et al. |
| 4,959,278 | A | | 9/1990 | Shimauch |
| 4,962,726 | A | | 10/1990 | Matsushita et al. |
| 4,979,464 | A | | 12/1990 | Kunze-Concewitz et al. |
| 4,982,215 | A | | 1/1991 | Matsuoka |
| 4,982,753 | A | | 1/1991 | Grebinski |
| 4,988,533 | A | | 1/1991 | Freeman |
| 5,000,827 | A | | 3/1991 | Schuster |
| 5,020,200 | A | | 6/1991 | Mimasaka |
| 5,024,746 | A | | 6/1991 | Stierman et al. |
| 5,026,239 | A | | 6/1991 | Chiba |
| 5,032,217 | A | | 7/1991 | Tanaka |
| 5,048,589 | A | | 9/1991 | Cook et al. |
| 5,054,988 | A | | 10/1991 | Shiraiwa |
| 5,055,036 | A | | 10/1991 | Asano et al. |
| 5,061,144 | A | | 10/1991 | Akimoto |
| 5,069,548 | A | | 12/1991 | Boehnlein |
| 5,078,852 | A | | 1/1992 | Yee |
| 5,083,364 | A | | 1/1992 | Olbrich et al. |
| 5,096,550 | A | | 3/1992 | Mayer |
| 5,110,248 | A | | 5/1992 | Asano et al. |
| 5,115,430 | A | | 5/1992 | Hahne |
| 5,117,769 | A | | 6/1992 | DeBoer |
| 5,125,784 | A | | 6/1992 | Asano |
| 5,128,912 | A | | 7/1992 | Hug et al. |
| 5,135,636 | A | | 8/1992 | Yee |
| 5,138,973 | A | | 8/1992 | Davis |
| 5,146,136 | A | | 9/1992 | Ogura |
| 5,151,168 | A | | 9/1992 | Gilton |
| 5,155,336 | A | | 10/1992 | Gronet et al. |
| 5,156,174 | A | | 10/1992 | Thompson |
| 5,156,730 | A | | 10/1992 | Bhatt |
| 5,168,886 | A | | 12/1992 | Thompson et al. |
| 5,168,887 | A | | 12/1992 | Thompson |
| 5,169,408 | A | | 12/1992 | Biggerstaff et al. |
| 5,172,803 | A | | 12/1992 | Lewin |
| 5,174,045 | A | | 12/1992 | Thompson et al. |
| 5,178,512 | A | | 1/1993 | Skrobak |

5,178,639 A 1/1993 Nishi
5,180,273 A 1/1993 Salaya et al.
5,183,377 A 2/1993 Becker et al.
5,186,594 A 2/1993 Toshima et al.
5,209,180 A 5/1993 Shoda
5,209,817 A 5/1993 Ahmad
5,217,586 A 6/1993 Datta
5,222,310 A 6/1993 Thompson
5,224,503 A 7/1993 Thompson
5,224,504 A 7/1993 Thompson et al.
5,227,041 A 7/1993 Brogden
5,228,232 A 7/1993 Miles
5,228,966 A 7/1993 Murata
5,230,371 A 7/1993 Lee
5,232,511 A 8/1993 Bergman
5,235,995 A 8/1993 Bergman et al.
5,238,500 A 8/1993 Bergman
5,252,137 A 10/1993 Tateyama et al.
5,252,807 A 10/1993 Chizinsky
5,256,262 A 10/1993 Blomsterberg
5,256,274 A 10/1993 Poris
5,271,953 A 12/1993 Litteral
5,271,972 A 12/1993 Kwok et al.
5,301,700 A 4/1994 Kamikawa et al.
5,302,464 A 4/1994 Nomura
5,306,895 A 4/1994 Ushikoshi et al.
5,314,294 A 5/1994 Taniguchi et al.
5,316,642 A 5/1994 Young
5,326,455 A 7/1994 Kubo et al.
5,330,604 A 7/1994 Allum et al.
5,332,271 A 7/1994 Grant et al.
5,332,445 A 7/1994 Bergman
5,340,456 A 8/1994 Mehler
5,344,491 A 9/1994 Katou
5,348,620 A 9/1994 Hermans et al.
5,349,978 A 9/1994 Sago
5,361,449 A 11/1994 Akimoto
5,363,171 A 11/1994 Mack
5,364,504 A 11/1994 Smurkoski et al.
5,366,785 A 11/1994 Sawdai
5,366,786 A 11/1994 Connor et al.
5,368,711 A 11/1994 Poris
5,372,848 A 12/1994 Blackwell
5,376,176 A 12/1994 Kuriyama
5,377,708 A 1/1995 Bergman
5,388,945 A 2/1995 Garric et al.
5,391,285 A 2/1995 Lytle
5,391,517 A 2/1995 Gelatos et al.
5,393,624 A 2/1995 Ushijima
5,405,518 A 4/1995 Hsieh et al.
5,411,076 A 5/1995 Matsunaga et al.
5,421,893 A 6/1995 Perlov
5,421,987 A 6/1995 Tzanavaras et al.
5,427,674 A 6/1995 Langenskiold et al.
5,429,686 A 7/1995 Chiu et al.
5,429,733 A 7/1995 Ishida
5,431,421 A 7/1995 Thompson
5,431,803 A 7/1995 DiFranco et al.
5,437,777 A 8/1995 Kishi
5,441,629 A 8/1995 Kosaki
5,442,416 A 8/1995 Tateyama et al.
5,443,707 A 8/1995 Mori
5,445,484 A 8/1995 Kato et al.
5,447,615 A 9/1995 Ishida
5,454,405 A 10/1995 Hawes
5,460,478 A 10/1995 Akimoto et al.
5,464,313 A 11/1995 Ohsawa
5,472,502 A 12/1995 Batchelder
5,474,807 A 12/1995 Koshiishi
5,489,341 A 2/1996 Bergman et al.
5,500,081 A 3/1996 Bergman
5,501,768 A 3/1996 Hermans et al.
5,508,095 A 4/1996 Allum et al.
5,510,645 A 4/1996 Fitch
5,512,319 A 4/1996 Cook et al.
5,513,594 A 5/1996 McClanahan
5,514,258 A 5/1996 Brinket et al.
5,516,412 A 5/1996 Andricacos et al.
5,522,975 A 6/1996 Andricacos et al.
5,527,390 A 6/1996 Ono et al.
5,544,421 A 8/1996 Thompson et al.
5,549,808 A 8/1996 Farooq
5,551,986 A 9/1996 Jain
5,567,267 A 10/1996 Kazama et al.
5,571,325 A 11/1996 Ueyama
5,575,611 A 11/1996 Thompson et al.
5,584,310 A 12/1996 Bergman
5,584,971 A 12/1996 Komino
5,591,262 A 1/1997 Sago
5,593,545 A 1/1997 Rugowski et al.
5,597,460 A 1/1997 Reynolds
5,597,836 A 1/1997 Hackler et al.
5,600,532 A 2/1997 Michiya et al.
5,609,239 A 3/1997 Schlecker
5,616,069 A 4/1997 Walker
5,620,581 A 4/1997 Ang
5,639,206 A 6/1997 Oda et al.
5,639,316 A 6/1997 Cabral
5,641,613 A 6/1997 Boff et al.
5,650,082 A 7/1997 Anderson
5,651,823 A 7/1997 Parodi et al.
5,651,836 A 7/1997 Suzuki
5,658,183 A 8/1997 Sandhu
5,658,387 A 8/1997 Reardon
5,660,472 A 8/1997 Peuse et al.
5,660,517 A 8/1997 Thompson et al.
5,662,788 A 9/1997 Sandhu
5,664,337 A 9/1997 Davis et al.
5,666,985 A 9/1997 Smith
5,670,034 A 9/1997 Lowery
5,676,337 A 10/1997 Giras et al.
5,677,118 A 10/1997 Spara et al.
5,677,824 A 10/1997 Harashima
5,678,116 A 10/1997 Sugimoto
5,678,320 A 10/1997 Thompson et al.
5,681,392 A 10/1997 Swain
5,683,564 A 11/1997 Reynolds
5,684,654 A 11/1997 Searle et al.
5,684,713 A 11/1997 Asada
5,700,127 A 12/1997 Harada
5,700,180 A 12/1997 Sandhu
5,711,646 A 1/1998 Ueda et al.
5,718,763 A 2/1998 Tateyama
5,719,495 A 2/1998 Moslehi
5,723,028 A 3/1998 Poris
5,731,678 A 3/1998 Zila et al.
5,744,019 A 4/1998 Ang
5,746,565 A 5/1998 Tepolt
5,747,098 A 5/1998 Larson
5,754,842 A 5/1998 Minagawa
5,755,948 A 5/1998 Lazaro et al.
5,759,006 A 6/1998 Miyamoto et al.
5,762,708 A 6/1998 Motoda
5,762,751 A 6/1998 Bleck
5,765,444 A 6/1998 Bacchi
5,765,889 A 6/1998 Nam et al.
5,776,327 A 7/1998 Botts et al.
5,779,796 A 7/1998 Tomoeda
5,785,826 A 7/1998 Greenspan
5,788,829 A 8/1998 Joshi et al.
5,802,856 A 9/1998 Schaper et al.
5,815,762 A 9/1998 Sakai
5,829,791 A 11/1998 Kotsubo et al.
5,843,296 A 12/1998 Greespan
5,845,662 A 12/1998 Sumnitsch
5,860,640 A 1/1999 Marohl 5,868,866 A 2/1999 Maekawa
5,871,626 A 2/1999 Crafts
5,871,805 A 2/1999 Lemelson
5,872,633 A 2/1999 Holzapfel
5,882,433 A 3/1999 Ueno
5,882,498 A 3/1999 Dubin
5,885,755 A 3/1999 Nakagawa
5,892,207 A 4/1999 Kawamura et al.
5,900,663 A 5/1999 Johnson
5,904,827 A 5/1999 Reynolds
5,908,543 A 6/1999 Matsunami
5,916,366 A 6/1999 Ueyama
5,924,058 A 7/1999 Waldhauer
5,925,227 A 7/1999 Kobayashi et al.
5,932,077 A 8/1999 Reynolds
5,937,142 A 8/1999 Moslehi et al.
5,942,035 A 8/1999 Hasebe
5,948,203 A 9/1999 Wang
5,952,050 A 9/1999 Doan
5,957,836 A 9/1999 Johnson
5,964,643 A 10/1999 Birang
5,980,706 A 11/1999 Bleck
5,985,126 A 11/1999 Bleck
5,989,397 A 11/1999 Laube
5,989,406 A 11/1999 Beetz
5,997,653 A 12/1999 Yamasaka
5,998,123 A 12/1999 Tanaka et al.
5,999,886 A 12/1999 Martin
6,001,235 A 12/1999 Arken et al.
6,004,047 A 12/1999 Akimoto
6,004,828 A 12/1999 Hanson
6,017,437 A 1/2000 Ting
6,017,820 A 1/2000 Ting et al.
6,025,600 A 2/2000 Archie
6,027,631 A 2/2000 Broadbent
6,028,986 A 2/2000 Song
6,045,618 A 4/2000 Raoux
6,051,284 A 4/2000 Byrne
6,053,687 A 4/2000 Kirkpatrick
6,063,190 A 5/2000 Hasebe et al.
6,072,160 A 6/2000 Bahl
6,072,163 A 6/2000 Armstrong et al.
6,074,544 A 6/2000 Reid
6,077,412 A 6/2000 Ting
6,080,288 A 6/2000 Schwartz et al.
6,080,291 A 6/2000 Woodruff et al.
6,080,691 A 6/2000 Lindsay et al.
6,086,680 A 7/2000 Foster et al.
6,090,260 A 7/2000 Inoue
6,091,498 A 7/2000 Hanson
6,099,702 A 8/2000 Reid
6,099,712 A 8/2000 Ritzdorf
6,103,085 A 8/2000 Woo et al.
6,107,192 A 8/2000 Subrahmanyan et al.
6,108,937 A 8/2000 Raaijmakers
6,110,011 A 8/2000 Somekh
6,110,346 A 8/2000 Reid
6,122,046 A 9/2000 Almogy
6,130,415 A 10/2000 Knoot
6,132,289 A 10/2000 Labunsky
6,132,587 A 10/2000 Jorne et al.
6,136,163 A 10/2000 Cheung
6,139,703 A 10/2000 Hanson et al.
6,139,708 A 10/2000 Nonomura et al.
6,139,712 A 10/2000 Patton
6,140,234 A 10/2000 Uzoh et al.
6,143,147 A 11/2000 Jelinek
6,143,155 A 11/2000 Adams
6,149,729 A 11/2000 Iwata
6,151,532 A 11/2000 Barone
6,156,167 A 12/2000 Patton
6,157,106 A 12/2000 Tietz et al.
6,159,073 A 12/2000 Wiswesser
6,159,354 A 12/2000 Contolini
6,162,344 A 12/2000 Reid
6,162,488 A 12/2000 Gevelber et al.
6,168,693 B1 1/2001 Uzoh
6,168,695 B1 1/2001 Woodruff
6,174,425 B1 1/2001 Simpson
6,174,796 B1 1/2001 Takagi et al.
6,179,983 B1 1/2001 Reid
6,184,068 B1 2/2001 Ohtani et al.
6,187,072 B1 2/2001 Cheung
6,190,234 B1 2/2001 Swedek
6,193,802 B1 2/2001 Pang
6,193,859 B1 2/2001 Contolini
6,194,628 B1 2/2001 Pang
6,197,181 B1 3/2001 Chen
6,199,301 B1 3/2001 Wallace
6,201,240 B1 3/2001 Dotan
6,208,751 B1 3/2001 Almogy
6,218,097 B1 4/2001 Bell et al.
6,221,230 B1 4/2001 Takeuchi
6,228,232 B1 5/2001 Woodruff
6,231,743 B1 5/2001 Etherington
6,234,738 B1 5/2001 Kimata
6,238,539 B1 5/2001 Joyce
6,244,931 B1 6/2001 Pinson
6,247,998 B1 6/2001 Wiswesser
6,251,238 B1 6/2001 Kaufman et al.
6,251,528 B1 6/2001 Uzoh et al.
6,251,692 B1 6/2001 Hanson
6,254,742 B1 7/2001 Hanson et al.
6,255,222 B1 7/2001 Xia
6,258,220 B1 7/2001 Dordi
6,261,433 B1 7/2001 Landau
6,264,752 B1 7/2001 Curtis
6,268,289 B1 7/2001 Chowdhury
6,270,619 B1 8/2001 Suzuki
6,270,634 B1 8/2001 Kumar et al.
6,270,647 B1 8/2001 Graham
6,277,194 B1 8/2001 Thilderkvist
6,277,263 B1 8/2001 Chen
6,278,089 B1 8/2001 Young et al.
6,280,183 B1 8/2001 Mayur et al.
6,280,582 B1 8/2001 Woodruff et al.
6,280,583 B1 8/2001 Woodruff et al.
6,290,865 B1 9/2001 Lloyd
6,297,154 B1 10/2001 Gross et al.
6,303,010 B1 10/2001 Woodruff et al.
6,309,520 B1 10/2001 Woodruff et al.
6,309,524 B1 10/2001 Woodruff et al.
6,309,981 B1 10/2001 Mayer
6,309,984 B1 10/2001 Nonaka
6,318,385 B1 11/2001 Curtis
6,318,951 B1 11/2001 Schmidt
6,322,112 B1 11/2001 Duncan
6,322,677 B1 11/2001 Woodruff
6,333,275 B1 12/2001 Mayer
6,342,137 B1 1/2002 Woodruff
6,350,319 B1 2/2002 Curtiss
6,365,729 B1 4/2002 Tyagi et al.
6,391,166 B1 5/2002 Wang
6,399,505 B2 6/2002 Nogami
6,402,923 B1 6/2002 Mayer
6,409,892 B1 6/2002 Woodruff et al.
6,413,436 B1 7/2002 Aegerter
6,423,642 B1 7/2002 Peace
6,428,660 B2 8/2002 Woodruff et al.
6,428,662 B1 8/2002 Woodruff et al.
6,444,101 B1 9/2002 Stevens et al.
6,471,913 B1 10/2002 Weaver et al.
6,481,956 B1 11/2002 Hofmeister
6,491,806 B1 12/2002 Dubin
6,494,221 B1 12/2002 Sellmer
6,497,801 B1 12/2002 Woodruff

| | | | | |
|---|---|---|---|---|
| 6,562,421 | B2 | 5/2003 | Sudo et al. | |
| 6,565,729 | B2 | 5/2003 | Chen et al. | |
| 6,569,297 | B2 | 6/2003 | Wilson et al. | |
| 6,599,412 | B1 | 7/2003 | Graham | |
| 6,623,609 | B2 | 9/2003 | Harris et al. | |
| 6,632,334 | B2 | 10/2003 | Anderson et al. | |
| 6,654,122 | B1 | 11/2003 | Hanson | |
| 6,660,137 | B2 | 12/2003 | Wilson et al. | |
| 6,672,820 | B1 | 1/2004 | Hanson | |
| 6,678,055 | B2 | 1/2004 | Du-Nour et al. | |
| 6,699,373 | B2 | 5/2004 | Woodruff et al. | |
| 6,709,562 | B1 | 5/2004 | Andricacos et al. | |
| 6,755,954 | B2 | 6/2004 | Mayer et al. | |
| 6,773,571 | B1 | 8/2004 | Mayer | |
| 6,921,467 | B2 * | 7/2005 | Hanson et al. | 204/212 |
| 7,102,763 | B2 * | 9/2006 | Ritzdorf et al. | 356/630 |
| 7,264,698 | B2 * | 9/2007 | Hanson et al. | 204/263 |
| 7,351,315 | B2 * | 4/2008 | Klocke et al. | 204/232 |
| 2001/0024611 | A1 | 9/2001 | Woodruff | |
| 2001/0032788 | A1 | 10/2001 | Woodruff | |
| 2001/0043856 | A1 | 11/2001 | Woodruff | |
| 2002/0008036 | A1 | 1/2002 | Wang | |
| 2002/0008037 | A1 | 1/2002 | Wilson | |
| 2002/0022363 | A1 | 2/2002 | Ritzdorf et al. | |
| 2002/0032499 | A1 | 3/2002 | Wilson | |
| 2002/0046952 | A1 | 4/2002 | Graham | |
| 2002/0079215 | A1 | 6/2002 | Wilson et al. | |
| 2002/0096508 | A1 | 7/2002 | Weaver et al. | |
| 2002/0125141 | A1 | 9/2002 | Wilson | |
| 2002/0139678 | A1 | 10/2002 | Wilson | |
| 2003/0020928 | A1 | 1/2003 | Ritzdorf | |
| 2003/0038035 | A1 | 2/2003 | Wilson | |
| 2003/0062258 | A1 | 4/2003 | Woodruff | |
| 2003/0066752 | A1 | 4/2003 | Ritzdorf | |
| 2003/0070918 | A1 | 4/2003 | Hanson | |
| 2003/0127337 | A1 | 7/2003 | Hanson | |
| 2004/0031693 | A1 | 2/2004 | Chen | |
| 2004/0055877 | A1 | 3/2004 | Wilson | |
| 2004/0099533 | A1 | 5/2004 | Wilson | |
| 2004/0188259 | A1 | 9/2004 | Wilson | |

FOREIGN PATENT DOCUMENTS

| | | | |
|---|---|---|---|
| DE | 3240330 | | 5/1984 |
| DE | 4202194 | | 7/1993 |
| DE | 195 25 666 | | 10/1996 |
| EP | 0 140 404 | A1 | 8/1984 |
| EP | 0047132 | B1 | 7/1985 |
| EP | 0 677 612 | A3 | 10/1985 |
| EP | 0 257 670 | | 3/1988 |
| EP | 0 290 210 | | 11/1988 |
| EP | 0290210 | | 11/1988 |
| EP | 0 677 612 | A2 | 10/1995 |
| EP | 0582019 | B1 | 10/1995 |
| EP | 0544311 | B1 | 5/1996 |
| EP | 0 881 673 | A2 | 5/1998 |
| EP | 0 924 754 | A2 | 10/1998 |
| EP | 0 982 771 | A1 | 8/1999 |
| EP | 1 037 261 | A2 | 3/2000 |
| EP | 1 069 213 | A2 | 7/2000 |
| EP | 0452939 | B1 | 11/2000 |
| EP | 105174 | | 12/2000 |
| FR | 2763343 | | 11/1998 |
| GB | 2217107 | A | 3/1989 |
| GB | 2 254 288 | A | 3/1992 |
| GB | 4109955 | | 10/1992 |
| GB | 41 14 427 | | 11/1992 |
| GB | 2 279 372 | A | 6/1994 |
| JP | 52-12576 | | 1/1977 |
| JP | 59-150094 | | 8/1984 |
| JP | 59-208831 | | 11/1984 |
| JP | 60-137016 | | 7/1985 |
| JP | 61-196534 | | 8/1986 |
| JP | 62-166515 | | 7/1987 |
| JP | 63-185029 | | 7/1988 |
| JP | 1048442 | | 2/1989 |
| JP | 1-120023 | | 5/1989 |
| JP | 1-283845 | | 11/1989 |
| JP | 4-94537 | | 3/1992 |
| JP | 4144150 | | 5/1992 |
| JP | H04-097856 | | 8/1992 |
| JP | 04-311591 | | 11/1992 |
| JP | 4311591 | | 11/1992 |
| JP | 5-13322 | | 1/1993 |
| JP | 5-21332 | | 1/1993 |
| JP | 5146984 | | 6/1993 |
| JP | 5195183 | A | 8/1993 |
| JP | 5211224 | | 8/1993 |
| JP | 5-326483 | | 12/1993 |
| JP | 6017291 | A | 1/1994 |
| JP | 6-45302 | | 2/1994 |
| JP | 6073598 | A | 3/1994 |
| JP | 6224202 | A | 8/1994 |
| JP | 7113159 | A | 5/1995 |
| JP | 7197299 | A | 8/1995 |
| JP | H07-197299 | | 8/1995 |
| JP | 8-279494 | | 11/1995 |
| JP | 9-181026 | | 7/1997 |
| JP | 10-083960 | | 3/1998 |
| JP | 11036096 | A | 2/1999 |
| JP | 11080993 | A | 3/1999 |
| WO | WO-90/00476 | | 1/1990 |
| WO | WO-91/04213 | | 4/1991 |
| WO | WO-95/06326 | | 3/1995 |
| WO | WO-95/20064 | | 7/1995 |
| WO | WO-99/16936 | | 4/1996 |
| WO | WO-99/25904 | | 5/1999 |
| WO | WO-99/25905 | | 5/1999 |
| WO | WO-99/40615 | | 8/1999 |
| WO | WO-99/41434 | | 8/1999 |
| WO | WO-99/45745 | | 9/1999 |
| WO | WO-00/02675 | | 1/2000 |
| WO | WO-00/02808 | | 1/2000 |
| WO | WO-00/03072 | | 1/2000 |
| WO | WO-00/32835 | | 6/2000 |
| WO | WO-00/61498 | | 10/2000 |
| WO | WO-00/61837 | | 10/2000 |
| WO | WO-01/46910 | | 6/2001 |
| WO | WO-01/90434 | | 11/2001 |
| WO | WO-01/91163 | | 11/2001 |
| WO | WO-02/02808 | | 1/2002 |
| WO | WO-02/04886 | | 1/2002 |
| WO | WO-02/04887 | | 1/2002 |
| WO | WO-02/17203 | | 2/2002 |
| WO | WO-02/45476 | | 6/2002 |
| WO | WO-02/097165 | | 12/2002 |
| WO | WO-02/099165 | | 12/2002 |
| WO | WO-03/018874 | | 3/2003 |

OTHER PUBLICATIONS

International Search Report for PCT/US02/28071; Applicant: Semitool, Inc., Dec. 13, 2002, 4 pgs.

PCT International Search Report for PCT/US02/17840, Applicant: Semitool, Inc., Mar. 2003, 5 pages.

European Search Report for European Patent Application No. EP 00 92 2221, Applicant: Semitool, Inc., Jul. 18, 2006, 3 pages.

Singer, Peter, "Nonuniformity of Copper Electroplating Studied," www.reed-electronics.com/semiconductor/index.asp?layout=articlePrint&articleID-CA164126rl, Semiconductor International, Jun. 1, 1998, 2 pages.

Office Action issued by the Japanese Patent Office on Jun. 2, 2008 in Japanese Patent Application No. 2000-610779. Applicant is Semitool, Inc.

Contolini et al., "Copper Electroplating Process for Sub-Half-Micron ULSI Structures," VMIC Conference 1995 ISMIC—04/95/0322, pp. 322-328, Jun. 17-29, 1995.

Devaraj et al., "Pulsed Electrodeposition of Copper," Plating & Surface Finishing, pp. 72-78, Aug. 1992.

Dubin, "Copper Plating Techniques for ULSI Metallization," Advanced MicroDevices, 1998.

Dubin, V.M., "Electrochemical Deposition of Copper for On-Chip Interconnects," Advanced MicroDevices.

Gauvin et al., "The Effect of Chloride Ions on Copper Deposition," J. of Electrochemical Society, vol. 99, pp. 71-75, Feb. 1952.

International Search Report for PCT/US02/17840; Applicant: Semitool, Inc., Mar. 3, 2003, 4 pgs.

International Search Report PCT/US02/17203; Semitool, Inc., Dec. 31, 2002, 4 pgs.

Lee, Tien-Yu Tom et al., "Application of a CFD Tool in Designing a Fountain Plating Cell for Uniform Bump Plating of Semiconductor Wafers," IEEE Transactions On Components, Packaging and Manufacturing Technology—Part B, Feb. 1996, pp. 131-137, vol. 19, No. 1, IEEE.

Lowenheim, Frederick A., "Electroplaiting," Jan. 1979, 12 pgs, McGraw-Hill Book Company, USA.

Lowenheim, Frederick A., "Electroplating Electrochemistry Applied to Electroplating," 1978, pp. 152-155, McGraw-Hill Book Company, New York.

Ossro, N.M., "An Overview of Pulse Plating," Plating and Surface Finishing, Mar. 1986.

Passal, F., "Copper Plating During the Last Fifty Years," Plating, pp. 628-638, Jun. 1959.

Patent Abstract of Japan, "Organic Compound and its Application," Publciation No. 08-003153, Publication Date: Jan. 9, 1996.

Patent Abstract of Japan, "Partial Plating Device," Publciation No. 01234590, Publication Date: Sep. 19, 1989.

Patent Abstract of Japan, "Plating Method" Publication No. 57171690, Publication Date: Oct. 22, 1982.

Patent Abstract of Japan, English Abstract Translation—Japanese Utility Model No. 2538705, Publication Date: Aug. 25, 1992.

Ritter, G., et al., "Two-And Three-Dimensional Numerical Modeling of Copper Electroplating for Advanced ULSI Metallization," Jun. 1999, 13 pgs, E-MRS Conference Symposium M. Basic Models to Enhance Reliability, Strasbourg, France.

Singer, P., "Copper Goes Mainstream: Low k to Follow," Semiconductor International, pp. 67-70, Nov. 1997.

* cited by examiner

FLOW VELOCITY COMPONENTS NORMAL TO WAFER

SYSTEM FOR ELECTROCHEMICALLY PROCESSING A WORKPIECE

CROSS-REFERENCE TO RELATED APPLICATIONS

This application is a continuation of U.S. application Ser. No. 10/715,700, filed Nov. 18, 2003 now abandoned, which is a continuation of U.S. application Ser. No. 09/804,697, filed Mar. 12, 2001, which issued on Dec. 9, 2003 as U.S. Pat. No. 6,660,137, which is a continuation of prior International Application No. PCT/US00/10120, filed Apr. 13, 2000 in the English language and published in the English language as International Publication No. WO 00/61498, which in turn claims priority to the following three U.S. Provisional Applications: U.S. Ser. No. 60/129,055, entitled "WORKPIECE PROCESSOR HAVING IMPROVED PROCESSING CHAMBER", filed Apr. 13, 1999; U.S. Ser. No. 60/143,769, entitled "WORKPIECE PROCESSING HAVING IMPROVED PROCESSING CHAMBER," filed Jul. 12, 1999; U.S. Ser. No. 60/182,160 entitled "WORKPIECE PROCESSOR HAVING IMPROVED PROCESSING CHAMBER", filed Feb. 14, 2000. The entire disclosures of all three of the prior applications, as well as International Publication No. WO 00/61498, are incorporated herein by reference.

STATEMENT REGARDING FEDERALLY SPONSORED RESEARCH OR DEVELOPMENT

Not Applicable

BACKGROUND OF THE INVENTION

The fabrication of microelectronic components from a microelectronic workpiece, such as a semiconductor wafer substrate, polymer substrate, etc., involves a substantial number of processes. For purposes of the present application, a microelectronic workpiece is defined to include a workpiece formed from a substrate upon which microelectronic circuits or components, data storage elements or layers, and/or micromechanical elements are formed. There are a number of different processing operations performed on the microelectronic workpiece to fabricate the microelectronic component (s). Such operations include, for example, material deposition, patterning, doping, chemical mechanical polishing, electropolishing, and heat treatment.

Material deposition processing involves depositing or otherwise forming thin layers of material on the surface of the microelectronic workpiece (hereinafter described as, but not limited to, a semiconductor wafer). Patterning provides removal of selected portions of these added layers. Doping of the semiconductor wafer, or similar microelectronic workpiece, is the process of adding impurities known as "dopants" to the selected portions of the wafer to alter the electrical characteristics of the substrate material. Heat treatment of the semiconductor wafer involves heating and/or cooling the wafer to achieve specific process results. Chemical mechanical polishing involves the removal of material through a combined chemical/mechanical process while electropolishing involves the removal of material from a workpiece surface using electrochemical reactions.

Numerous processing devices, known as processing "tools", have been developed to implement the foregoing processing operations. These tools take on different configurations depending on the type of workpiece used in the fabrication process and the process or processes executed by the tool. One tool configuration, known as the LT-210C™ processing tool and available from Semitool, Inc., of Kalispell, Mont., includes a plurality of microelectronic workpiece processing stations that utilize a workpiece holder and a process bowl or container for implementing wet processing operations. Such wet processing operations include electroplating, etching, cleaning, electroless deposition, electropolishing, etc. In connection with the present invention, it is the electrochemical processing stations used in the LT-210C™ that are noteworthy. Such electrochemical processing stations perform the foregoing electroplating, electropolishing, anodization, etc., of the microelectronic workpiece. It will be recognized that the electrochemical processing system set forth herein is readily adapted to implement each of the foregoing electrochemical processes.

In accordance with one configuration of the LT-210C™ tool, the electroplating stations include a workpiece holder and a process container that are disposed proximate one another. The workpiece holder and process container are operated to bring the microelectronic workpiece held by the workpiece holder into contact with an electroplating fluid disposed in the process container to form a processing chamber. Restricting the electroplating solution to the appropriate portions of the workpiece, however, is often problematic. Additionally, ensuring proper mass transfer conditions between the electroplating solution and the surface of the workpiece can be difficult. Absent such mass transfer control, the electrochemical processing of the workpiece surface can often be non-uniform. This can be particularly problematic in connection with the electroplating of metals. Still further, control of the shape and magnitude of the electric field is increasingly important.

Conventional electrochemical reactors have utilized various techniques to bring the electroplating solution into contact as with the surface of the workpiece in a controlled manner. For example, the electroplating solution may be brought into contact with the surface of the workpiece using partial or full immersion processing in which the electroplating solution resides in a processing container and at least one surface of the workpiece is brought into contact with or below the surface of the electroplating solution.

Electroplating and other electrochemical processes have become important in the production of semiconductor integrated circuits and other microelectronic devices from microelectronic workpieces. For example, electroplating is often used in the formation of one or more metal layers on the workpiece. These metal layers are often used to electrically interconnect the various devices of the integrated circuit. Further, the structures formed from the metal layers may constitute microelectronic devices such as read/write heads, etc.

Electroplated metals typically include copper, nickel, gold, platinum, solder, nickel-iron, etc. Electroplating is generally, effected by initial formation of a seed layer on the microelectronic workpiece in the form of a very thin layer of metal, whereby the surface of the microelectronic workpiece is rendered electrically conductive. This electro-conductivity permits subsequent formation of a blanket or patterned layer of the desired metal by electroplating. Subsequent processing, such as chemical mechanical planarization, may be used to remove unwanted portions of the patterned or metal blanket layer formed during electroplating, resulting in the formation of the desired metallized structure.

Electropolishing of metals at the surface of a workpiece involves the removal of at least some of the metal using an electrochemical process. The electrochemical process is effectively the reverse of the electroplating reaction and is often carried out using the same or similar reactors as electroplating.

Existing electroplating processing containers often provide a continuous flow of electroplating solution to the electroplating chamber through a single inlet disposed at the bottom portion of the chamber. One embodiment of such a processing container is illustrated in FIG. 1A. As illustrated, the electroplating reactor, shown generally at 1, includes a electroplating processing container 2 that is used to contain a flow of electroplating solution provided through a fluid inlet 3 disposed at a lower portion of the container 2. In such a reactor, the electroplating solution completes an electrical circuit path between an anode 4 and a surface of workpiece 5, which functions as a cathode.

The electroplating reactions that take place at the surface of the microelectronic workpiece are dependent on species mass transport (e.g., copper ions, platinum ions, gold ions, etc.) to the microelectronic workpiece surface through a diffusion layer (a.k.a. mass transport layer) that forms proximate the microelectronic workpiece's surface. It is desirable to have a diffusion layer that is both thin and uniform over the surface of the microelectronic workpiece if a uniform electroplated film is to be deposited within a reasonable amount of time.

Even distribution of the electroplating solution over the workpiece surface to control the thickness and uniformity of the diffusion layer in the processing container of FIG. 1A is facilitated, for example, by a diffuser 6 or the like that is disposed between the single inlet and the workpiece surface. The diffuser includes a plurality of apertures 7 that are provided to disburse the stream of electroplating fluid provided from the processing fluid inlet 3 as evenly as possible across the surface of the workpiece 5.

Although substantial improvements in diffusion layer control result from the use of a diffuser, such control is limited. With reference to FIG. 1A, localized areas 8 of increased flow velocity normal to the surface of the microelectronic workpiece are often generated by the diffuser 6. These localized areas generally correspond to the position of apertures 7 of the diffuser 6. This effect is increased as the diffuser 6 is moved closer to the workpiece.

The present inventors have found that these localized areas of increased flow velocity at the surface of the workpiece affect the diffusion layer conditions and can result in non-uniform deposition of the electroplated material over the surface of the workpiece. Diffuser hole pattern configurations also affect the distribution of the electric field since the diffuser is disposed between the anode and workpiece, and can result in non-uniform deposition of the electroplated material. In the reactor illustrated in FIG. 1A, the electric field tends to be concentrated at localized areas 8 corresponding to the apertures in the diffuser. These effects in the localized areas 8 are dependent on diffuser distance from the workpiece and the diffuser hole size and pattern.

Another problem often encountered in electroplating is disruption of the diffusion layer due to the entrapment and evolvement of gasses during the electroplating process. For example, bubbles can be created in the plumbing and pumping system of the processing equipment. Electroplating is thus inhibited at those sites on the surface of the workpiece to which the bubbles migrate. Gas evolvement is particularly a concern when an inert anode is utilized since inert anodes tend to generate gas bubbles as a result of the anodic reactions that take place at the anode's surface.

Consumable anodes are often used to reduce the evolvement of gas bubbles in the electroplating solution and to maintain bath stability. However, consumable anodes frequently have a passivated film surface that must be maintained. They also erode into the plating solution changing the dimensional tolerances. Ultimately, the) must be replaced thereby increasing the amount of maintenance required to keep the tool operational when compared to tools using inert anodes.

Another challenge associated with the plating of uniform films is the changing resistance of the plated film. The initial seed layer can have a high resistance and this resistance decreases as the film becomes thicker. The changing resistance makes it difficult for a given set of chamber hardware to yield optimal uniformity on a variety of seed layers and deposited film thicknesses.

In view of the foregoing, the present inventors have developed a system for electrochemically processing a microelectronic workpiece that can readily adapt to a wide range of electrochemical processing requirements (e.g., seed layer thicknesses, seed layer types, electroplating materials, electrolyte bath properties, etc.). The system can adapt to such electrochemical processing requirements while concurrently providing a controlled, substantially uniform diffusion layer at the surface of the workpiece that assists in providing a corresponding substantially uniform processing of the workpiece surface (e.g., uniform deposition of the electroplated material).

SUMMARY OF THE INVENTIONS

A reactor for electrochemically processing at least one surface of a microelectronic workpiece is set forth. The reactor comprises a reactor head including a workpiece support that has one or more electrical contacts positioned to make electrical contact with the microelectronic workpiece. The reactor also includes a processing container having a plurality of nozzles angularly disposed in a sidewall of a principal fluid flow chamber at a level within the principal fluid flow chamber below a surface of a bath of processing fluid normally contained therein during electrochemical processing. A plurality of anodes are disposed at different elevations in the principal fluid flow chamber so as to place them at different distances from a microelectronic workpiece under process without an intermediate diffuser between the plurality of anodes and the microelectronic workpiece under process. One or more of the plurality of anodes may be in close proximity to the workpiece under process. Still further, one or more of the plurality of anodes may be a virtual anode. The present invention also relates to multi-level anode configurations within a principal fluid flow chamber and methods of using the same.

DETAILED DESCRIPTION OF THE INVENTION

Basic Reactor Components

Figure 1A:
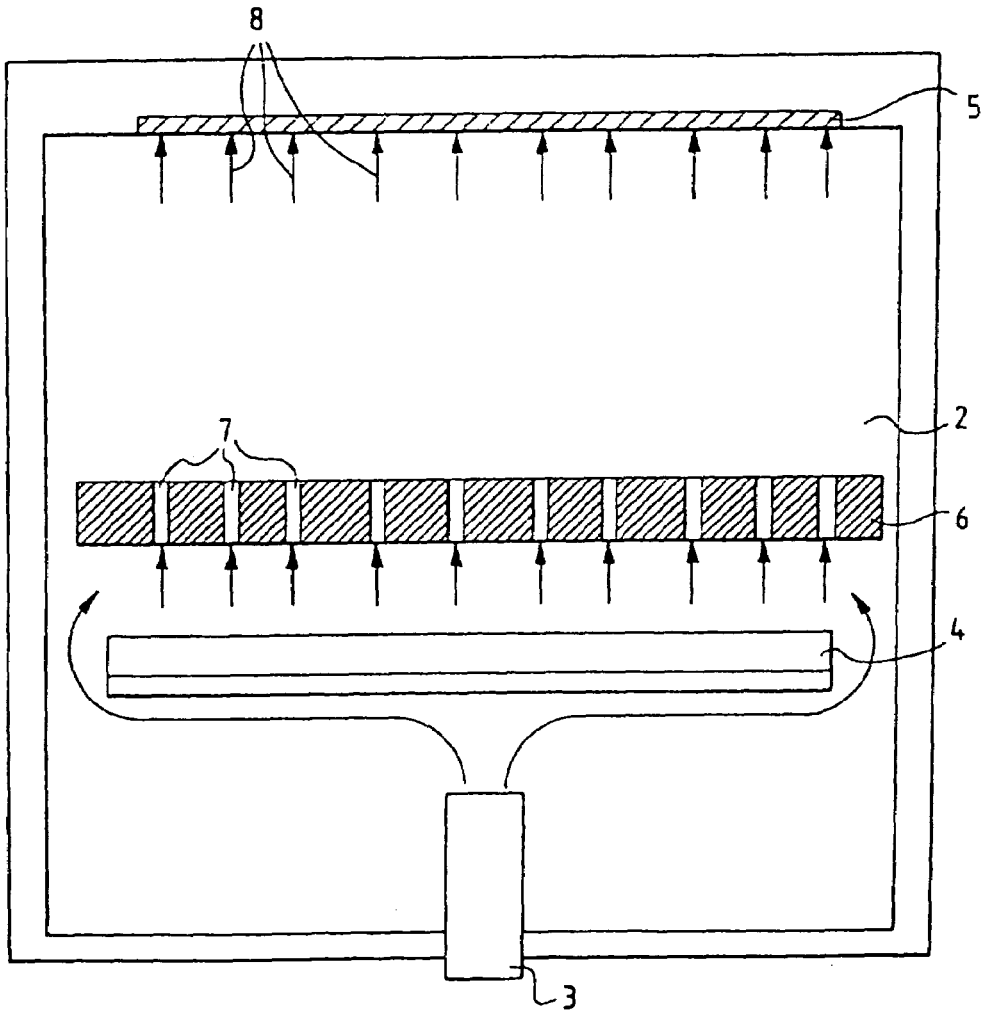
FIG. 1A PRIOR ART
FIG. 1A is schematic block diagram of an immersion processing reactor assembly that incorporates a diffuser to distribute a flow of processing fluid across a surface of a workpiece.
Figure 1B:
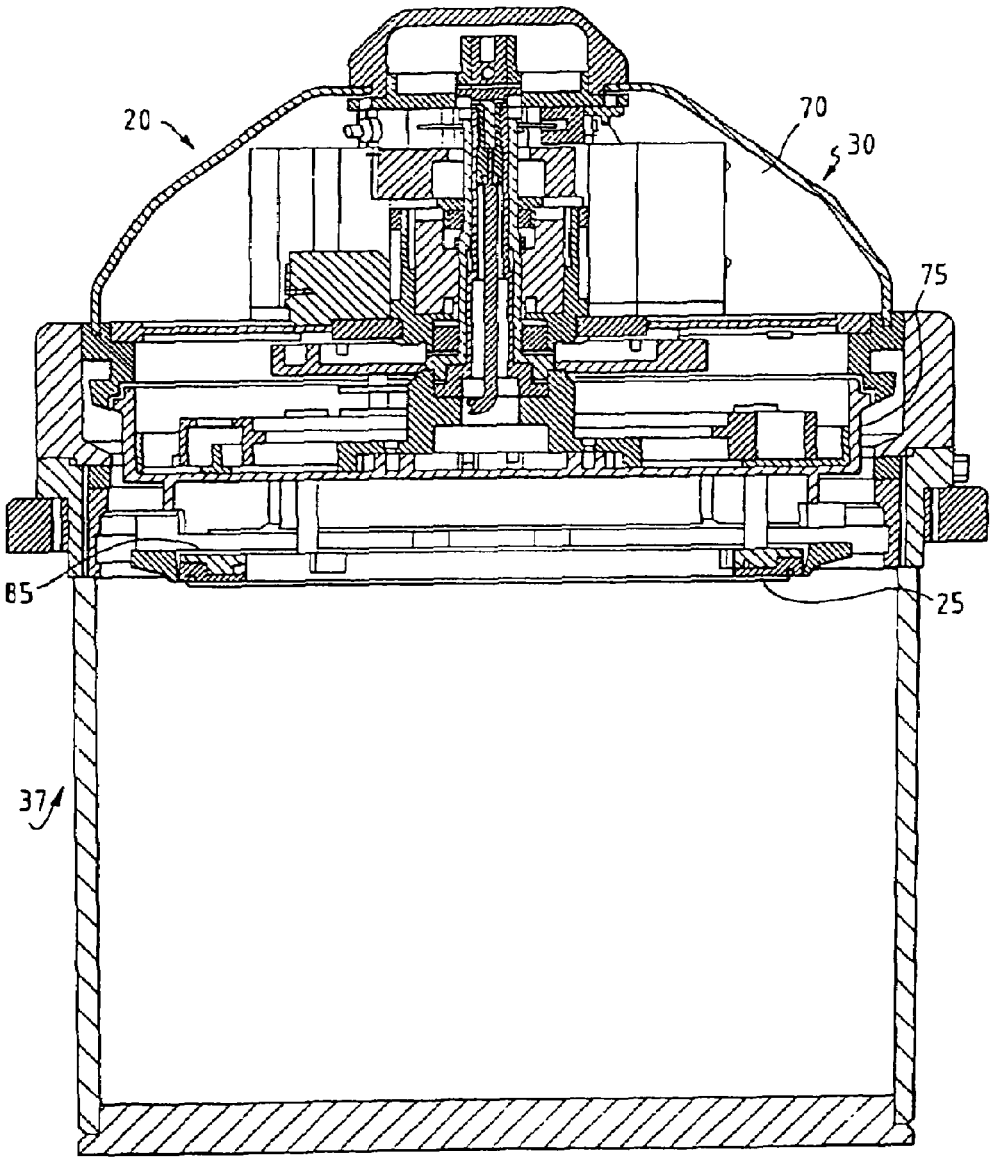
FIG. 1B is a cross-sectional view of one embodiment of a reactor assembly that may incorporate the present invention.

With reference to FIG. 1B, there is shown a reactor assembly 20 for electroplating a microelectronic workpiece 25, such as a semiconductor wafer. Generally stated, the reactor assembly 20 is comprised of a reactor head 30 and a corresponding reactor base, shown generally at 37 and described in substantial detail below, in which the electroplating solution is disposed. The reactor of FIG. 1B can also be used to implement electrochemical processing operations other than electroplating (e.g., electropolishing, anodization, etc.).

The reactor head 30 of the electroplating reactor assembly may comprised of a stationary assembly 70 and a rotor assembly 75. Rotor assembly 75 is configured to receive and carry an associated microelectronic workpiece 25, position the microelectronic workpiece in a process-side down orientation within a container of reactor base 37, and to rotate or spin the workpiece while joining its electrically-conductive surface in the plating circuit of the reactor assembly 20. The rotor assembly 75 includes one or more cathode contacts that provide electroplating power to the surface of the microelectronic workpiece. In the illustrated embodiment, a cathode contact assembly is shown generally at 85 and is described in further detail below. It will be recognized, however, that backside contact may be implemented in lieu of front side contact when the substrate is conductive or when an alternative electrically conductive path is provided between the back side of the microelectronic workpiece and the front side thereof.

The reactor head 30 is typically mounted on a lift/rotate apparatus which is configured to rotate the reactor head 30 from an upwardly-facing disposition in which it receives the microelectronic workpiece to be plated, to a downwardly facing disposition in which the surface of the microelectronic workpiece to be plated is positioned so that it may be brought into contact with the electroplating solution in reactor base 37, either planar or at a given angle. A robotic arm, which preferably includes an end effector, is typically employed for placing the microelectronic workpiece 25 in position on the rotor assembly 75, and for removing the plated microelectronic workpiece from within the rotor assembly. The contact assembly 85 may be operated between an open state that allows the microelectronic workpiece to be placed on the rotor assembly 75, and a closed state that secures the microelectronic workpiece to the rotor assembly and brings the electrically conductive components of the contact assembly 85 into electrical engagement with the surface of the microelectronic workpiece that is to be plated.

It will be recognized that other reactor assembly configurations may be used with the inventive aspects of the disclosed reactor chamber, the foregoing being merely illustrative.

Electrochemical Processing Container

Figure 2:
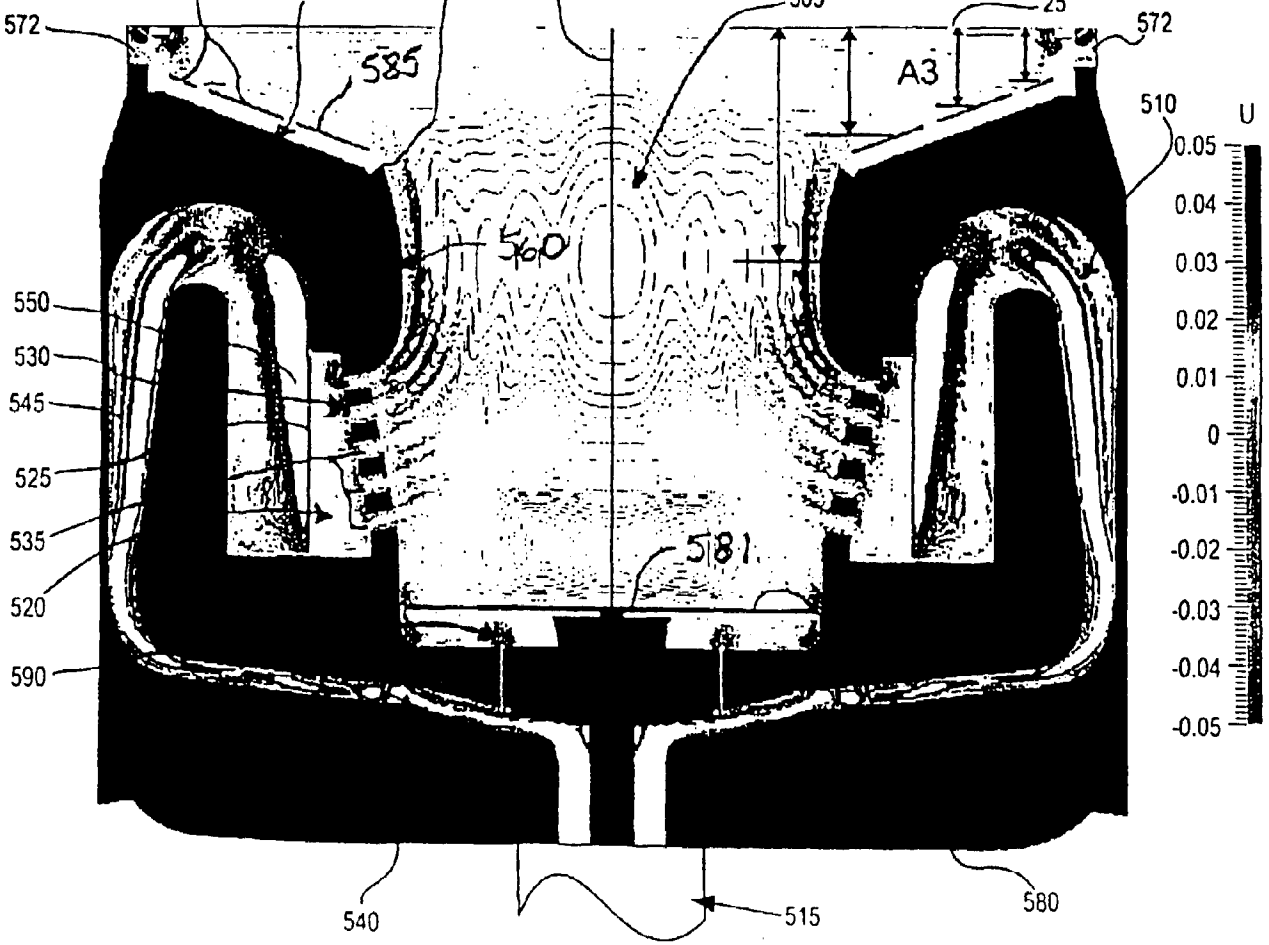
FIG. 2 is a schematic diagram of one embodiment of a reactor chamber that may be used in the reactor assembly of FIG. 1B and includes an illustration of the velocity flow profiles associated with the flow of processing fluid through the reactor chamber.

FIG. 2 illustrates the basic construction of processing base 37 and a corresponding computer simulation of the flow velocity contour pattern resulting from the processing container construction. As illustrated, the processing base 37 generally comprises a main fluid flow chamber 505, an antechamber 510, a fluid inlet 515, a plenum 520, a flow diffuser 525 separating the plenum 520 from the antechamber 510, and a nozzle slot assembly 530 separating the plenum 520 from the main chamber 505. These components cooperate to provide a flow of electrochemical processing fluid (here, of the electroplating solution) at the microelectronic workpiece 25 that has a substantially radially independent normal component. In the illustrated embodiment, the impinging flow is centered about central axis 537 and possesses a nearly uniform component normal to the surface of the microelectronic workpiece 25. This results in a substantially uniform mass flux to the microelectronic workpiece surface that, in turn, enables substantially uniform processing thereof.

Notably, as will be clear from the description below, this desirable flow characteristic is achieved without the use of a diffuser disposed between the anode(s) and surface of the microelectronic workpiece that is to be electrochemically processed (e.g., electroplated). As such, the anodes used in the electroplating reactor can be placed in close proximity to the surface of the microelectronic workpiece to thereby provide substantial control over local electrical field/current density parameters used in the electroplating process. This substantial degree of control over the electrical parameters allows the reactor to be readily adapted to meet a wide range of electroplating requirements (e.g., seed layer thickness, seed layer type, electroplated material, electrolyte bath properties, etc.) without a corresponding change in the reactor hardware. Rather, adaptations can be implemented by altering the electrical parameters used in the electroplating process through, for example, software control of the power provided to the anodes.

The reactor design thus effectively de-couples the fluid flow from adjustments to the electric field. An advantage of this approach is that a chamber with nearly ideal flow for electroplating and other electrochemical processes (i.e., a design which provides a substantially uniform diffusion layer across the microelectronic workpiece) may be designed that will not be degraded when electroplating or other electrochemical process applications require significant changes to the electric field.

The foregoing advantages can be more greatly appreciated through a comparison with the prior art reactor design illustrated in FIG. 1A. In that design, the diffuser must be moved closer to the surface of the workpiece if the distance between the anode and the workpiece surface is to be reduced. However, moving the diffuser closer to the workpiece significantly alters the flow characteristics of the electroplating fluid at the surface of the workpiece. More particularly, the close proximity between the diffuser and the surface of the workpiece introduces a corresponding increase in the magnitude of the normal components of the flow velocity at local areas 8. As such, the anode cannot be moved so that it is in close proximity to the surface of the microelectronic workpiece that is to be electroplated without introducing substantial diffusion layer control problems and undesirable localized increases in the electrical field corresponding to the pattern of apertures in the diffuser. Since the anode cannot be moved in close proximity to the surface of the microelectronic workpiece, the advantages associated with increased control of the electrical characteristics of the electrochemical process cannot be realized. Still further, movement of the diffuser to a position in close proximity with the microelectronic workpiece effectively generates a plurality of virtual anodes defined by the hole pattern of the diffuser. Given the close proximity of these virtual anodes to the microelectronic workpiece surface, the virtual anodes have a highly localized effect. This highly localized effect cannot generally be controlled with any degree of accuracy given that any such control is solely effected by varying the power to the single, real anode. A substantially uniform electroplated film is thus difficult to achieve with such a plurality of loosely controlled virtual anodes.

Figure 3A:
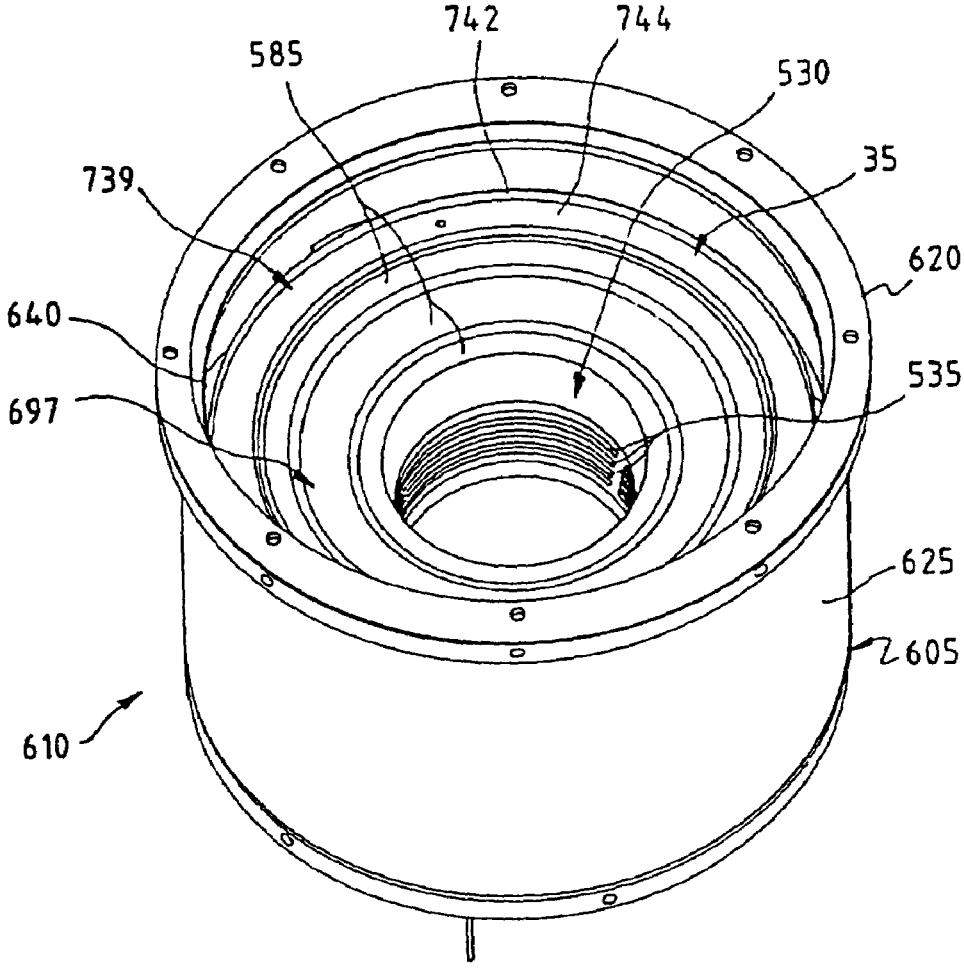
FIGS. 3A-5 illustrate a specific construction of a complete processing chamber assembly that has been specifically adapted for electrochemical processing of a semiconductor wafer and that has been implemented to achieve the velocity flow profiles set forth in FIG. 2.

With reference again to FIG. 2, electroplating solution is provided through inlet 515 disposed at the bottom of the base 37. The fluid from the inlet 515 is directed therefrom at a relatively high velocity through antechamber 510. In the illustrated embodiment, antechamber 510 includes an acceleration channel 540 through which the electroplating solution flows radially from the fluid inlet 515 toward fluid flow region 545 of antechamber 510. Fluid flow region 545 has a generally inverted U-shaped cross-section that is substantially wider at its outlet region proximate flow diffuser 525 than at its inlet region proximate channel 540. This variation in the cross-section assists in removing any gas bubbles from the electroplating solution before the electroplating solution is allowed to enter the main chamber 505. Gas bubbles that would otherwise enter the main chamber 505 are allowed to exit the processing base 37 through a gas outlet (not illustrated in FIG. 2, but illustrated in the embodiment shown in FIGS. 3-5) disposed at an upper portion of the antechamber 510.

Electroplating solution within antechamber 510 is ultimately supplied to main chamber 505. To this end, the electroplating solution is first directed to flow from a relatively high-pressure region 550 of the antechamber 510 to the comparatively lower-pressure plenum 520 through flow diffuser 525. Nozzle assembly 530 includes a plurality of nozzles or slots 535 that are disposed at a slight angle With respect to horizontal. Electroplating solution exits plenum 520 through nozzles 535 with fluid velocity components in the vertical and radial directions.

Main chamber 505 is defined at its upper region by a contoured sidewall 560 and a slanted sidewall 565. The contoured sidewall 560 assists in preventing fluid flow separation as the electroplating solution exits nozzles 535 (particularly the uppermost nozzle(s)) and turns upward toward the surface of microelectronic workpiece 25. Beyond breakpoint 570, fluid flow separation will not substantially affect the uniformity of the normal flow. As such, sidewall 565 can generally have any shape, including a continuation of the shape of contoured sidewall 560. In the specific embodiment disclosed here, sidewall 565 is slanted and, as will be explained in further detail below, is used to support one or more anodes.

Electroplating solution exits from main chamber 505 through a generally annular outlet 572. Fluid exiting outlet 572 may be provided to a further exterior chamber for disposal or may be replenished for re-circulation through the electroplating solution supply system.

The processing base 37 is also provided with one or more anodes. In the illustrated embodiment, a principal anode 580 is disposed in the lower portion of the main chamber 505. If the peripheral edges of the surface of the microelectronic workpiece 25 extend radially beyond the extent of contoured sidewall 560, then the peripheral edges are electrically shielded from principal anode 580 and reduced plating will take place in those regions. As such, a plurality of annular anodes 585 are disposed in a generally concentric manner on slanted sidewall 565 to provide a flow of electroplating current to the peripheral regions.

Anodes 580 and 585 of the illustrated embodiment are disposed at different distances from the surface of the microelectronic as workpiece 25 that is being electroplated. More particularly, the anodes 580 and 585 are concentrically disposed in different horizontal planes. Such a concentric arrangement combined with the vertical differences allow the anodes 580 and 585 to be effectively placed close to the surface of the microelectronic workpiece 25 without generating a corresponding adverse impact on the flow pattern as tailored by nozzles 535.

The effect and degree of control that an anode has on the electroplating of microelectronic workpiece 25 is dependent on the effective distance between that anode and the surface of the microelectronic workpiece that is being electroplated. More particularly, all other things being equal, an anode that is effectively spaced a given distance from the surface of microelectronic workpiece 25 will have an impact on a larger area of the microelectronic workpiece surface than an anode that is effectively spaced from the surface of microelectronic workpiece 25 by a lesser amount. Anodes that are effectively spaced at a comparatively large distance from the surface of microelectronic workpiece 25 thus have less localized control over the electroplating process than do those that are spaced at a smaller distance. It is therefore desirable to effectively locate the anodes in close proximity to the surface of microelectronic workpiece 25 since this allows more versatile, localized control of the electroplating process. Advantage can be taken of this increased control to achieve greater uniformity of the resulting electroplated film. Such control is exercised, for example, by placing the electroplating power provided to the individual anodes under the control of a programmable controller or the like. Adjustments to the electroplating power can thus be made subject to software control based on manual or automated inputs.

In the illustrated embodiment, anode 580 is effectively "seen" by microelectronic workpiece 25 as being positioned an approximate distance A1 from the surface of microelectronic workpiece 25. This is due to the fact that the relationship between the anode 580 and sidewall 560 creates a virtual anode having an effective area defined by the innermost dimensions of sidewall 560. In contrast, anodes 585 are approximately at effective distances A2, A3, and A4 proceeding from the innermost anode to the outermost anode, with the outermost anode being closest to the microelectronic workpiece 25. All of the anodes 585 are in close proximity (i.e., about 25.4 mm or less, with the outermost anode being spaced from the microelectronic workpiece by about 10 mm) to the surface of the microelectronic workpiece 25 that is being electroplated. Since anodes 585 are in close proximity to the surface of the microelectronic workpiece 25, they can be used to provide effective, localized control over the radial film growth at peripheral portions of the microelectronic workpiece. Such localized control is particularly desirable at the peripheral portions of the microelectronic workpiece since it is those portions that are more likely to have a high uniformity gradient (most often due to the fact that electrical contact is made with the seed layer of the microelectronic workpiece at the outermost peripheral regions resulting in higher plating rates at the periphery of the microelectronic workpiece compared to the central portions thereof).

The electroplating power provided to the foregoing anode arrangement can be readily controlled to accommodate a wide range of plating requirements without the need for a corresponding hardware modification. Some reasons for adjusting the electroplating power include changes to the following:

- seed layer thickness;
- open area of plating surface (pattern wafers, edge exclusion);
- final plated thickness;
- plated film type (copper, platinum, seed layer enhancement);
- bath conductivity, metal concentration; and
- plating rate.

The foregoing anode arrangement is particularly well-suited for plating microelectronic workpieces having highly resistive seed layers as well as for plating highly resistive materials on microelectronic workpieces. Generally stated, the more resistive the seed layer or material that is to be deposited, the more the magnitude of the current at the central anode 580 (or central anodes) should be increased to yield a uniform film. This effect can be understood in connection with an example and the set of corresponding graphs set forth in FIGS. 10 and 11.

Figure 10:
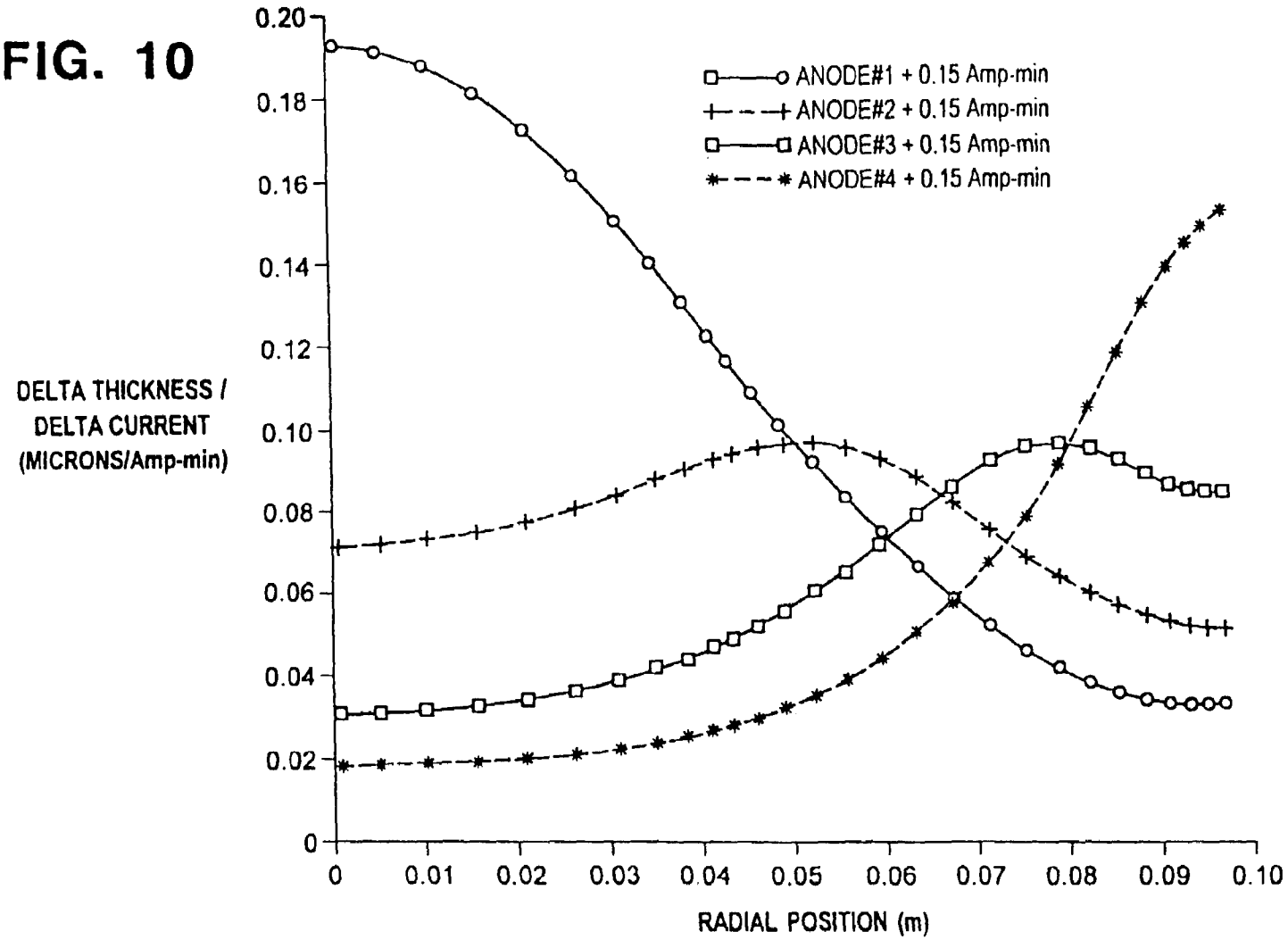
FIGS. 10 and 11 are graphs illustrating the manner in which the anode configuration of the processing chamber may be employed to achieve uniform plating.

FIG. 10 is a graph of four different computer simulations reflecting the change in growth of an electroplated film versus the radial position across the surface of a microelectronic workpiece. The graph illustrates the changing growth that occurs when the current to a given one of the four anodes 580, 585 is changed without a corresponding change in the current to the remaining anodes. In this illustration, Anode 1 corresponds to anode 580 and the remaining Anodes 2 through 4 correspond to anodes 585 proceeding from the interior most anode to the outermost anode. The peak plating for each anode occurs at a different radial position. Further, as can be seen from this graph, anode 580, being effectively at the largest distance from the surface of the workpiece, has an effect over a substantial radial portion of the workpiece and thus has a broad affect over the surface area of the workpiece. In contrast, the remaining anodes have substantially more localized effects at the radial positions corresponding to the peaks of the graph of FIG. 10.

The differential radial effectiveness of the anodes 580, 585 can be utilized to provide an effectively uniform electroplated film across the surface of the microelectronic workpiece. To this end, each of the anodes 580, 585 may be provided with a fixed current that may differ from the current provided to the remaining anodes. These plating current differences can be provided to compensate for the increased plating that generally occurs at the radial position of the workpiece surface proximate the contacts of the cathode contact assembly 85 (FIG. 1B).

Figure 11:
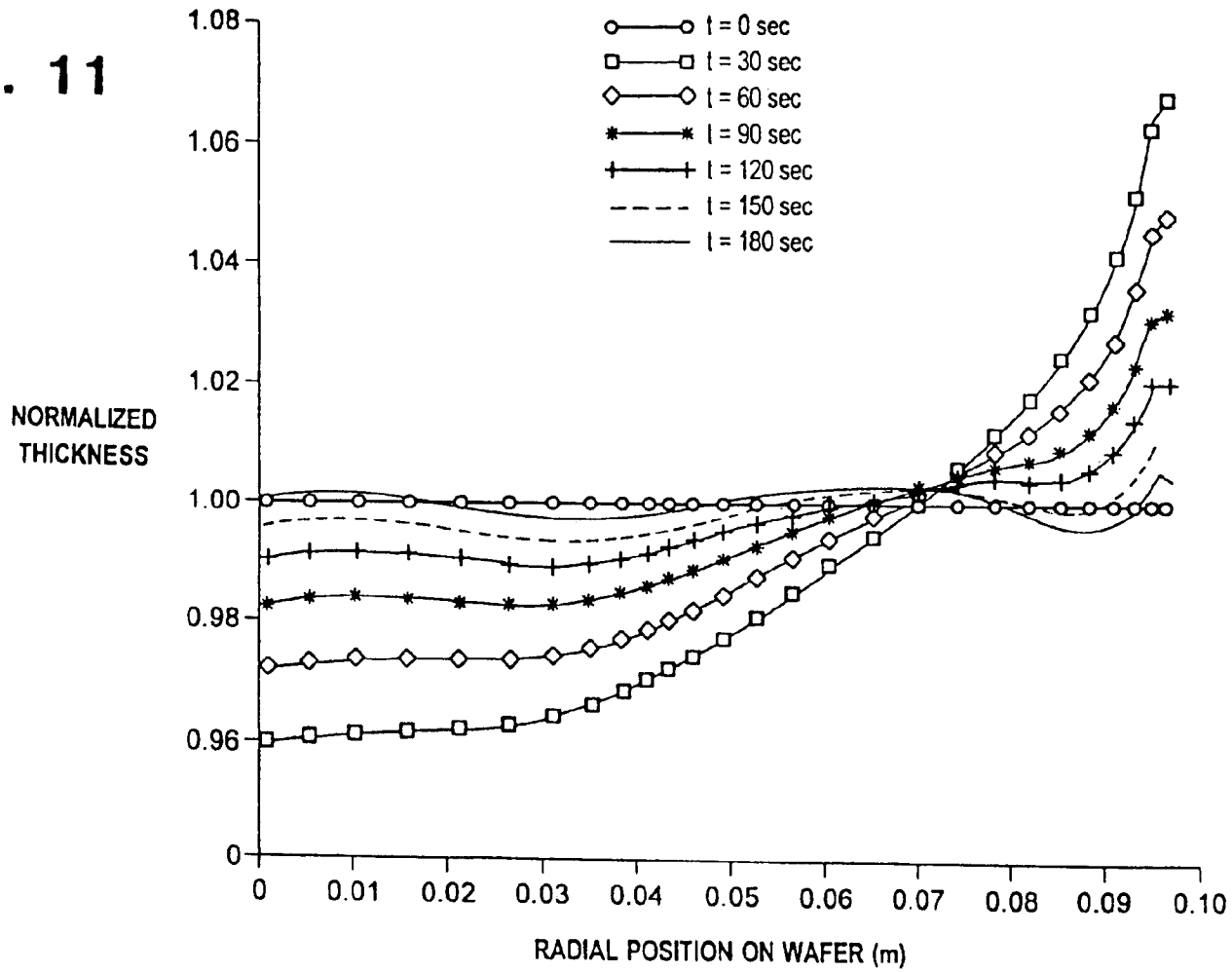

The computer simulated effect of a predetermined set of plating current differences on the normalized thickness of the electroplated film as a function of the radial position on the microelectronic workpiece over time is shown in FIG. 11. In this simulation, the seed layer was assumed to be uniform at t0. As illustrated, there is a substantial difference in the thickness over the radial position on the microelectronic workpiece during the initial portion of the electroplating process. This is generally characteristic of workpieces having seed layers that are highly resistive, such as those that are formed from a highly resistive material or that are very thin. However, as can be seen from FIG. 11, the differential plating that results from the differential current provided to the anodes 580, 585 forms a substantially uniform plated film by the end of the electroplating process. It will be recognized that the particular currents that are to be provided to anodes 580, 585 depends upon numerous factors including, but not necessarily limited to, the desired thickness and material of the electroplated film, the thickness and material of the initial seed layer, the distances between anodes 580, 585 and the surface of the microelectronic workpiece, electrolyte bath properties, etc.

Anodes 580, 585 may be consumable, but are preferably inert and formed from platinized titanium or some other inert conductive material. However, as noted above, inert anodes tend to evolve gases that can impair the uniformity of the plated film. To reduce this problem, as well as to reduce the likelihood of the entry of bubbles into the main processing chamber 505, processing base 37 includes several unique features. With respect to anode 580, a small fluid flow path forms a Venturi outlet 590 between the underside of anode 580 and the relatively lower pressure channel 540 (see FIG. 2). This results in a Venturi effect that causes the electroplating solution proximate the surfaces of anode 580 to be drawn away and, further, provides a suction flow (or recirculation flow) that affects the uniformity of the impinging flow at the central portion of the surface of the microelectronic workpiece.

The Venturi flow path 590 may be shielded to prevent any large bubbles originating from outside the chamber from rising through region 590. Instead, such bubbles enter the bubble-trapping region of the antechamber 510.

Similarly, electroplating solution sweeps across the surfaces of anodes 585 in a radial direction toward fluid outlet 572 to remove gas bubbles forming at their surfaces. Further, the radial components of the fluid flow at the surface of the microelectronic workpiece assist in sweeping gas bubbles therefrom.

There are numerous further processing advantages with respect to the illustrated flow through the reactor chamber. As illustrated, the flow through the nozzles 535 is directed away from the microelectronic workpiece surface and, as such, there are no jets of fluid created to disturb the uniformity of the diffusion layer. Although the diffusion layer may not be perfectly uniform, it will be substantially uniform, and any non-uniformity will be relatively gradual as a result. Further, the effect of any minor non-uniformity may be substantially reduced by rotating the microelectronic workpiece during processing. A further advantage relates to the flow at the bottom of the main chamber 505 that is produced by the Venturi outlet, which influences the flow at the centerline thereof. The centerline flow velocity is otherwise difficult to implement and control. However, the strength of the Venturi flow provides a non-intrusive design variable that may be used to affect this aspect of the flow.

As is also evident from the foregoing reactor design, the flow that is normal to the microelectronic workpiece has a slightly greater magnitude near the center of the microelectronic workpiece and creates a dome-shaped meniscus whenever the microelectronic workpiece is not present (i.e., before the microelectronic workpiece is lowered into the fluid). The dome-shaped meniscus assists in minimizing bubble entrapment as the microelectronic workpiece or other workpiece is lowered into the processing solution (here, the electroplating solution).

A still further advantage of the foregoing reactor design is that it assists in preventing bubbles that find their way to the chamber inlet from reaching the microelectronic workpiece. To this end, the flow pattern is such that the solution travels downward just before entering the main chamber. As such, bubbles remain in the antechamber and escape through holes at the top thereof. Further, the upward sloping inlet path (see FIG. 5 and appertaining description) to the antechamber prevents bubbles from entering the main chamber through the Venturi flow path.

Figure 3B:
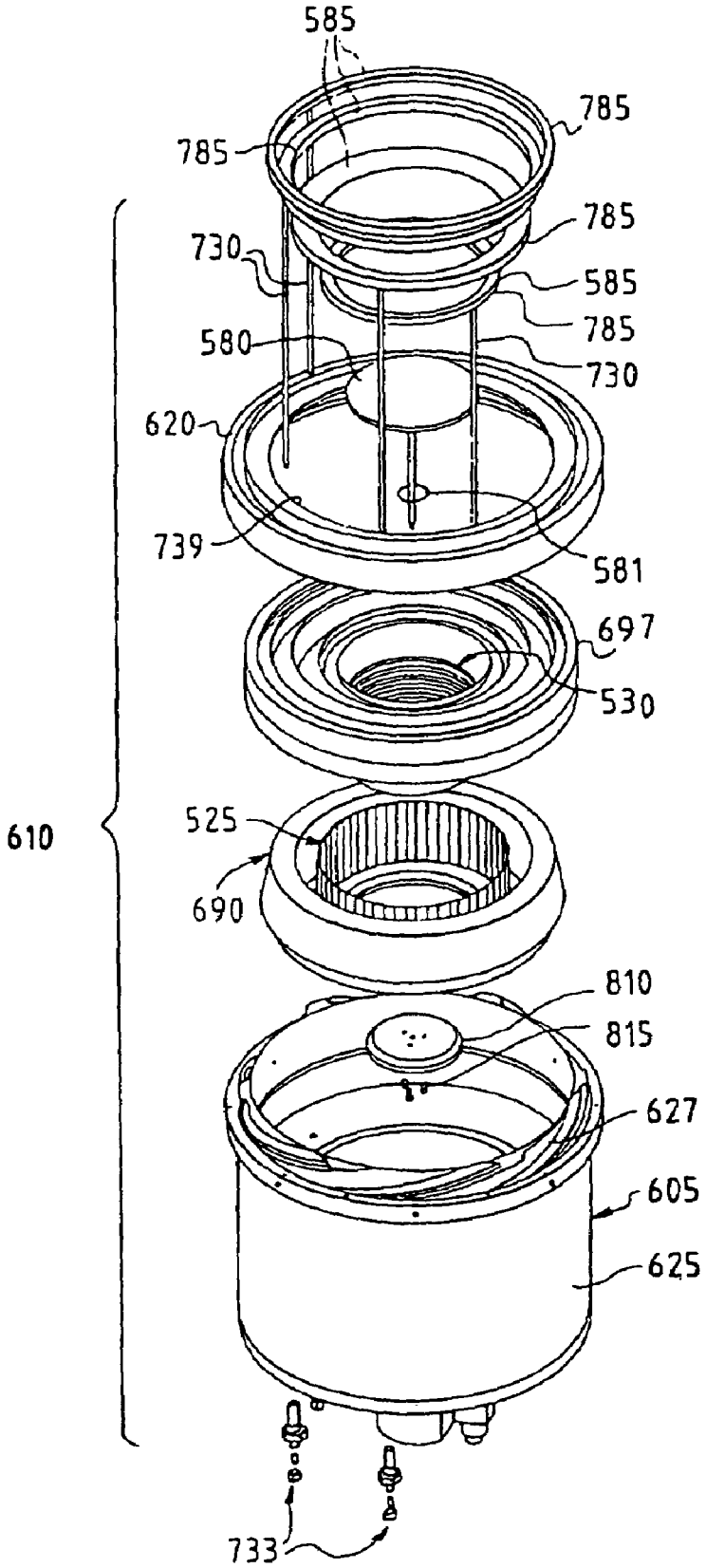
Figure 4:
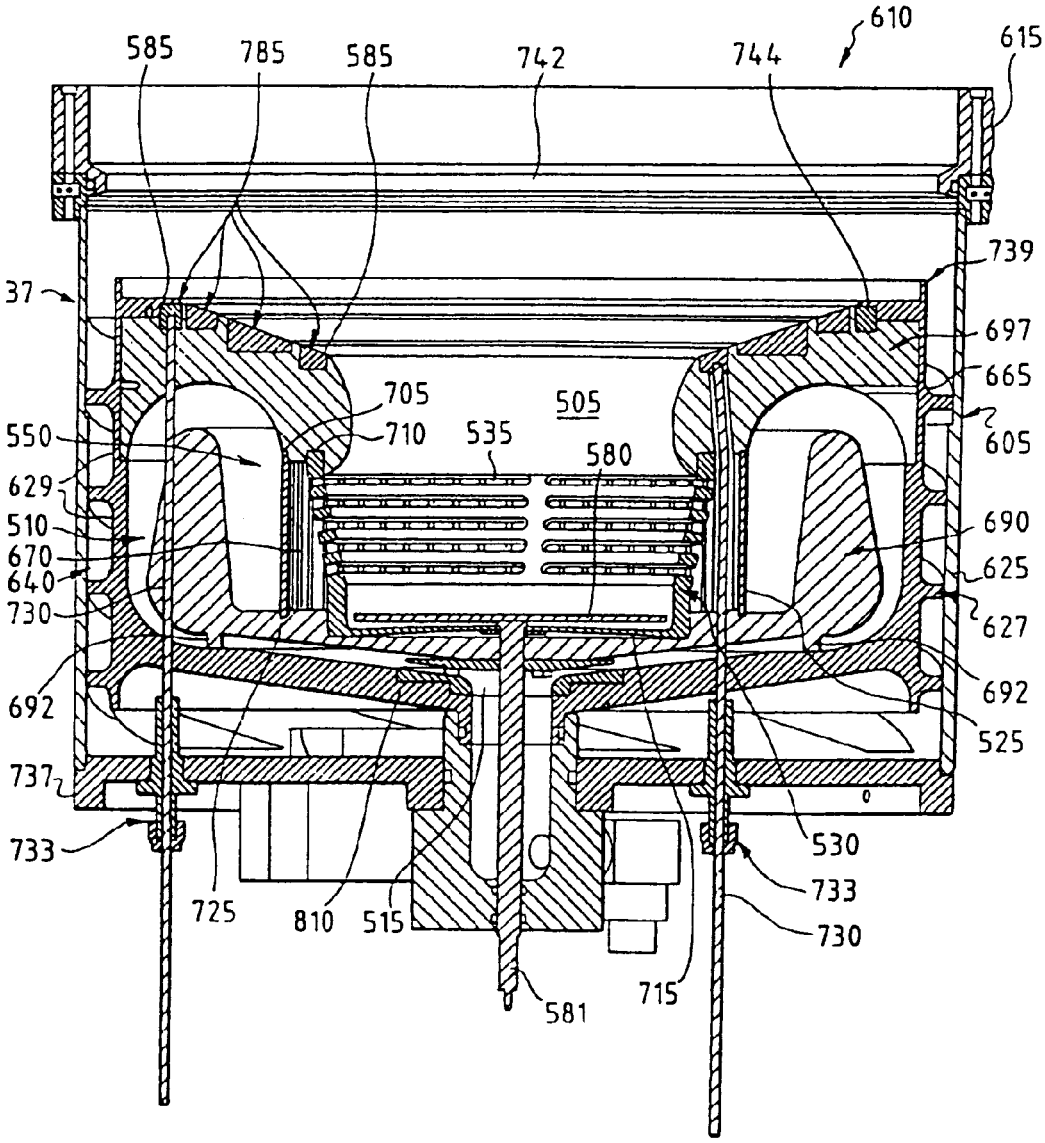
Figure 5:
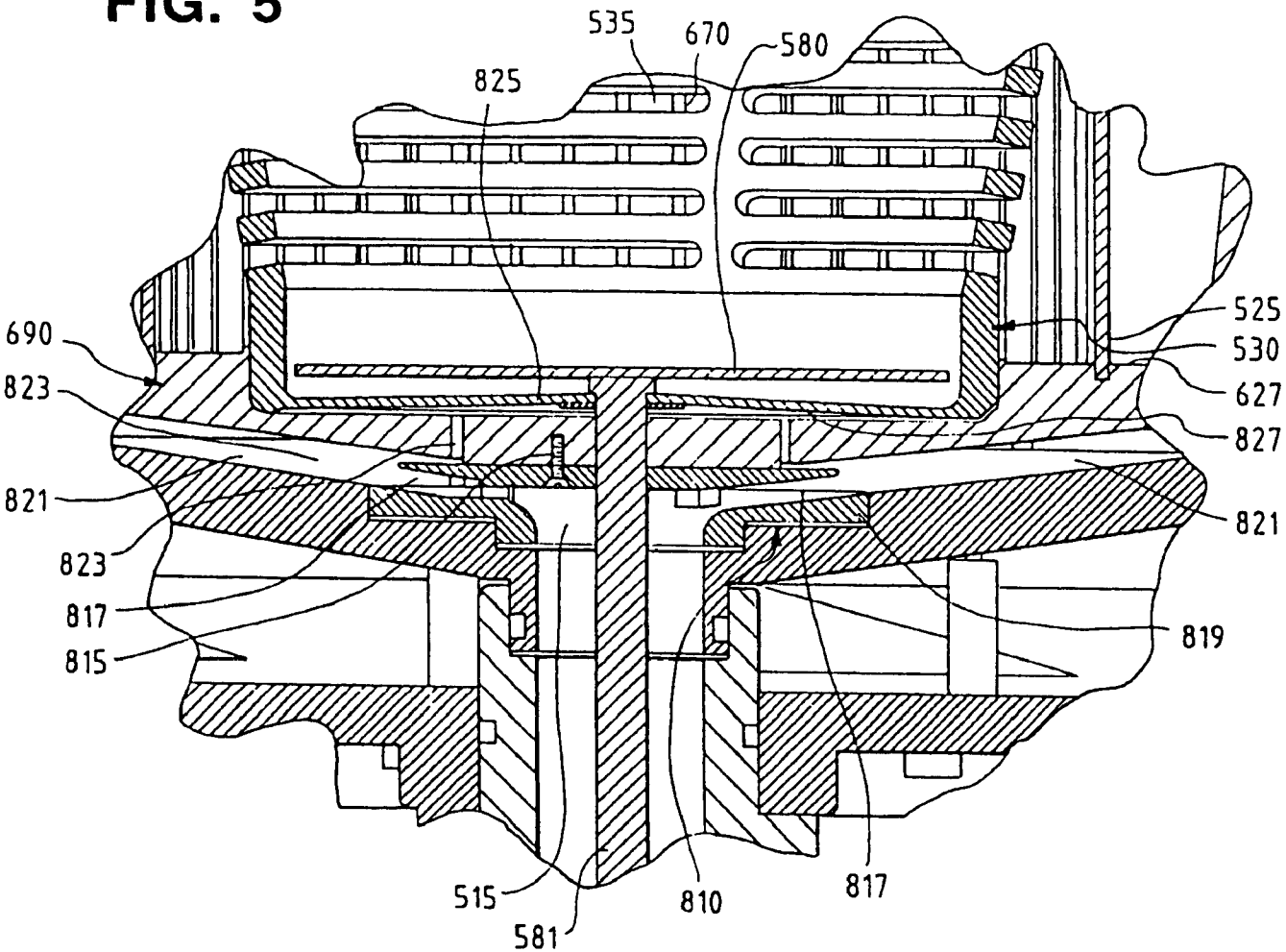

FIGS. 3-5 illustrate a specific construction of a complete processing chamber assembly 610 that has been specifically adapted for electrochemical processing of a semiconductor microelectronic workpiece. More particularly, the illustrated embodiment is specifically adapted for depositing a uniform layer of material on the surface of the workpiece using electroplating.

As illustrated, the processing base 37 shown in FIG. 1B is comprised of processing chamber assembly 610 along with a corresponding exterior cup 605. Processing chamber assembly 610 is disposed % within exterior cup 605 to allow exterior cup 605 to receive spent processing fluid that overflows from the processing chamber assembly 610. A flange 615 extends about the assembly 610 for securement with, for example, the frame of the corresponding tool.

With particular reference to FIGS. 4 and 5, the flange of the exterior cup 605 is formed to engage or otherwise accept rotor assembly 75 of reactor head 30 (shown in FIG. 1B) and allow contact between the microelectronic workpiece 25 and the processing solution, such as electroplating solution, in the main fluid flow chamber 505. The exterior cup 605 also includes a main cylindrical housing 625 into which a drain cup member 627 is disposed. The drain cup member 627 includes an outer surface having channels 629 that, together with the interior wall of main cylindrical housing 625, form one or more helical flow chambers 640 that serve as an outlet for the processing solution. Processing fluid overflowing a weir member 739 at the top of processing cup 35 drains through the helical flow chambers 640 and exits an outlet (not illustrated) where it is either disposed of or replenished and re-circulated. This configuration is particularly suitable for systems that include fluid re-circulation since it assists in reducing the mixing of gases with the processing solution thereby further reducing the likelihood that gas bubbles will interfere with the uniformity of the diffusion layer at the workpiece surface.

In the illustrated embodiment, antechamber 510 is defined by the walls of a plurality of separate components. More particularly, antechamber 510 is defined by the interior walls of drain cup member 627, an anode support member 697, the interior and exterior walls of a mid-chamber member 690, and the exterior walls of flow diffuser 525.

FIGS. 3B and 4 illustrate the manner in which the foregoing components are brought together to form the reactor. To this end, the mid-chamber member 690 is disposed interior of the drain cup member 627 and includes a plurality of leg supports 692 that sit upon a bottom wall thereof. The anode support member 697 includes an outer wall that engages a flange that is disposed about the interior of drain cup member 627. The anode support member 697 also includes a channel 705 that sits upon and engages an upper portion of flow diffuser 525, and a further channel 710 that sits upon and engages an upper rim of nozzle assembly 530. Mid-chamber member 690 also includes a centrally disposed receptacle 715 that is dimensioned to accept the lower portion of nozzle assembly 530. Likewise, an annular channel 725 is disposed radially exterior of the annular receptacle 715 to engage a lower portion of flow diffuser 525.

In the illustrated embodiment, the flow diffuser 525 is formed as a single piece and includes a plurality of vertically oriented slots 670. Similarly, the nozzle assembly 530 is formed as a single piece and includes a plurality of horizontally oriented slots that constitute the nozzles 535.

The anode support member 697 includes a plurality of annular grooves that are dimensioned to accept corresponding annular anode assemblies 785. Each anode assembly 785 includes an anode 585 (preferably formed from platinized titanium or another inert metal) and a conduit 730 extending from a central portion of the anode 585 through which a metal conductor may be disposed to electrically connect the anode 585 of each assembly 785 to an external source of electrical power. Conduit 730 is shown to extend entirely through the processing chamber assembly 610 and is secured at the bottom thereof by a respective fitting 733. In this manner, anode assemblies 785 effectively urge the anode support member 697 downward to clamp the flow diffuser 525, nozzle assembly 530, mid-chamber member 690, and drain cup member 627 against the bottom portion 737 of the exterior cup 605. This allows for easy assembly and disassembly of the processing chamber 610. However, it will be recognized that other means may be used to secure the chamber elements together as well as to conduct the necessary electrical power to the anodes.

The illustrated embodiment also includes a weir member 739 that detachably snaps or otherwise easily secures to the upper exterior portion of anode support member 697. As shown, weir member 739 includes a rim 742 that forms a weir over which the processing solution flows into the helical flow chamber 640. Weir member 739 also includes a transversely extending flange 744 that extends radially inward and forms an electric field shield over all or portions of one or more of the anodes 585. Since the weir member 739 may be easily removed and replaced, the processing chamber assembly 610 may be readily reconfigured and adapted to provide different electric field shapes. Such differing electrical field shapes are particularly useful in those instances in which the reactor must be configured to process more than one size or shape of a workpiece. Additionally, this allows the reactor to be configured to accommodate workpieces that are of the same size, but have different plating area requirements.

The anode support member 697, with the anodes 585 in place, forms the contoured sidewall 560 and slanted sidewall 565 that is illustrated in FIG. 2. As noted above, the lower region of anode support member 697 is contoured to define the upper interior wall of antechamber 510 and preferably includes one or more gas outlets 665 that are disposed therethrough to allow gas bubbles to exit from the antechamber 510 to the exterior environment.

With particular reference to FIG. 5, fluid inlet 515 is defined by an inlet fluid guide, shows generally at 810, that is secured to the floor of mid-chamber member 690 by one or more fasteners 815. Inlet fluid guide 810 includes a plurality of open channels 817 that guide fluid received at fluid inlet 515 to an area beneath mid-chamber member 690. Channels 817 of the illustrated embodiment are defined by upwardly angled walls 819. Processing fluid exiting channels 817 flows therefrom to one or more further channels 821 that are likewise defined by walls that angle upward.

Central anode 580 includes an electrical connection rod 581 that proceeds to the exterior of the processing chamber assembly 610 through central apertures formed in nozzle assembly 530, mid-chamber member 690 and inlet fluid guide 810. The small Venturi flow path regions shown at 590 in FIG. 2 are formed in FIG. 5 by vertical channels 823 that proceed through drain cup member 690 and the bottom wall of nozzle member 530. As illustrated, the fluid inlet guide 810 and, specifically, the upwardly angled walls 819 extend radially beyond the shielded vertical channels 823 so that any, bubbles entering the inlet proceed through the upward channels 821 rather than through the vertical channels 823.

FIGS. 6-9 illustrate a further embodiment of an improved reactor chamber. The embodiment illustrated in these figures retains the advantageous electric field and flow characteristics of the foregoing reactor construction while concurrently being useful for situations in which anode/electrode isolation is desirable. Such situations include, but are not limited to, the following:

- instances in which the electrochemical electroplating solution must pass over an electrode, such as an anode, at a high flow rate to be optimally effective;
- instances in which one or more gases evolving from the electrochemical reactions at the anode surface must be removed in order to insure uniform electrochemical processing; and
- instances in which consumable electrodes are used.

Figure 6:
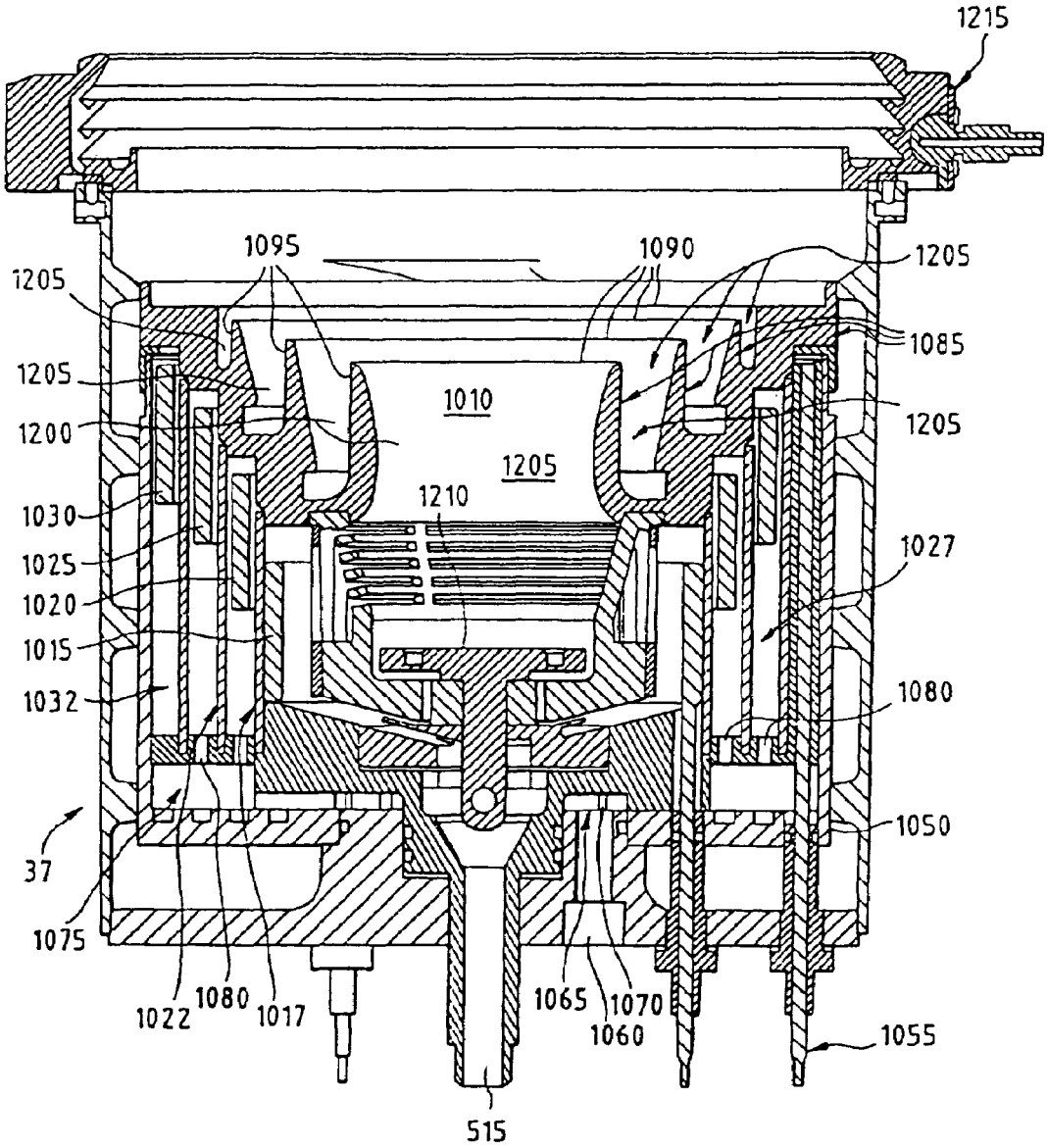
FIGS. 6 and 7 illustrate two embodiments of processing tools that may incorporate one or more processing stations constructed in accordance with the teachings of the present invention.
Figure 7:
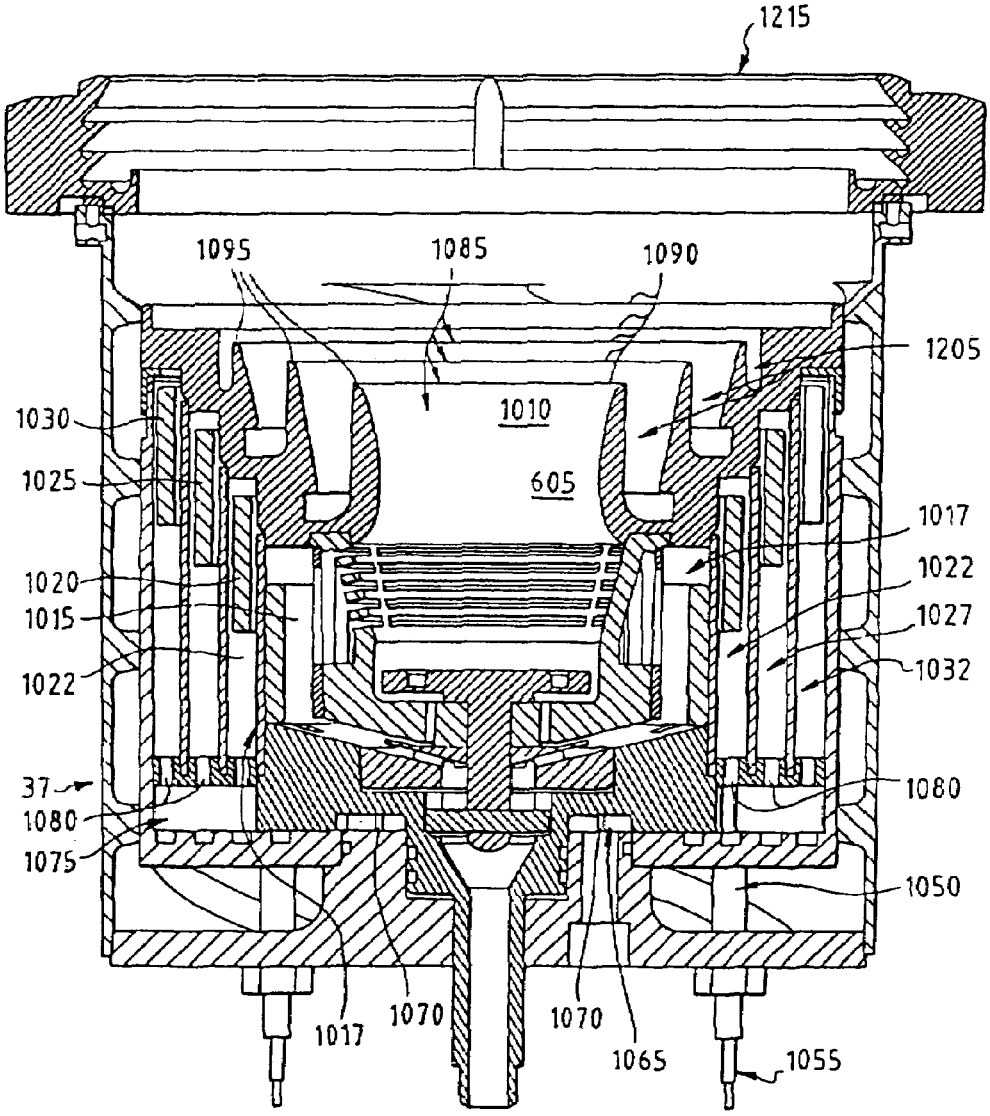

With reference to FIGS. 6 and 7, the reactor includes an electrochemical electroplating solution flow path into the innermost portion of the processing chamber that is very similar to the flow path of the embodiment illustrated in FIG. 2 and as implemented in the embodiment of the reactor chamber shown in FIGS. 3A through 5. As such, components that have similar functions are not further identified here for the sake of simplicity. Rather, only those portions of the reactor that significantly) differ from the foregoing embodiment are identified and described below.

A significant distinction between the embodiments exists, however, in connection with the anode electrodes and the appertaining structures and fluid flow paths. More particularly, the reactor based 37 includes a plurality of ring-shaped anodes 1015, 1020, 1025 and 1030 that are concentrically disposed with respect to one another in respective anode chamber housings 1017, 1022, 1027 and 1032. As shown, each anode 1015, 1020, 1025 and 1030 has a vertically oriented surface area that is greater than the surface area of the corresponding anodes shown in the foregoing embodiments. Four such anodes are employed in the disclosed embodiment, but a larger or smaller number of anodes may be used depending upon the electrochemical processing parameters and results that are desired. Each anode 1015, 1020, 1025 and 1030 is supported in the respective anode chamber housing 1017, 1022, 1027 and 1032 by at least one corresponding support/conductive member 1050 that extends through the bottom of the processing base 37 and terminates at an electrical connector 1055 for connection to an electrical power source.

In accordance with the disclosed embodiment, fluid flow to and through the three outer most chamber housings 1022, 1027 and 1032 is provided from an inlet 1060 that is separate from inlet 515, which supplies the fluid flow through an innermost chamber housing 1017. As shown, fluid inlet 1060 provides electroplating solution to a manifold 1065 having a plurality of slots 1070 disposed in its exterior wall. Slots 1070 are in fluid communication with a plenum 1075 that includes a plurality of openings 1080 through which the electroplating solution respectively enters the three anode chamber housings 1022, 1027 and 1032. Fluid entering the anode chamber housings 1017, 1022, 1027 and 1032 flows over at least one vertical surface and, preferably, both vertical surfaces of the respective anode 1015, 1020, 1025 and 1030.

Each anode chamber housing 1017, 1022, 1027 and 1032 includes an upper outlet region that opens to a respective cup 1085. Cups 1085, as illustrated, are disposed in the reactor chamber so that they are concentric with one another. Each cup includes an upper rim 1090 that terminates at a predetermined height with respect to the other rims, with the rim of each cup terminating at a height that is vertically below the immediately adjacent outer concentric cup. Each of the three innermost cups further includes a substantially vertical exterior wall 1095 and a slanted interior wall 1200. This wall construction creates a flow region 1205 in the interstitial region between concentrically disposed cups (excepting the innermost cup that has a contoured interior wall that defines the fluid flow region 1205 and than the outer most flow region 1205 associated with the outer most anode) that increases in area as the fluid flows upward toward the surface of the microelectronic workpiece under process. The increase in area effectively reduces the fluid flow velocity along the vertical fluid flow path, with the velocity being greater at a lower portion of the flow region 1205 when compared to the velocity of the fluid flow at the upper portion of the particular flow region.

The interstitial region between the rims of concentrically adjacent cups effectively defines the size and shape of each of a plurality of virtual anodes, each virtual anode being respectively associated with a corresponding anode disposed in its respective anode chamber housing. The size and shape of each virtual anode that is seen by the microelectronic workpiece under process is generally independent of the size and shape of the corresponding actual anode. As such, consumable anodes that vary in size and shape over time as they are used can be employed for anodes 1015, 1020, 1025 and 1030 without a corresponding change in the overall anode configuration is seen by the microelectronic workpiece under process. Further, given the deceleration experienced by the fluid flow as it proceeds vertically through flow regions 1205, a high fluid flow velocity may be introduced across the vertical surfaces of the anodes 1015, 1020, 1025 and 1030 in the anode chamber housings 1022, 1027 and 1032 while concurrently producing a very uniform fluid flow pattern radially across the surface of the microelectronic workpiece under process. Such a high fluid flow velocity across the vertical surfaces of the anodes 1015, 1020, 1025 and 1030, as noted above, is desirable when using certain electrochemical electroplating solutions, such as electroplating fluids available from Atotech. Further, such high fluid flow velocities may be used to assist in removing some of the gas bubbles that form at the surface of the anodes, particularly inert anodes. To this end, each of the anode chamber housings 1017, 1022, 1027 and 1032 may be provided with one or more gas outlets (not illustrated) at the upper portion thereof to vent such gases.

Of further note, unlike the foregoing embodiment, element 1210 is a securement that is formed from a dielectric material. The securement 1210 is used to clamp a plurality of the structures forming reactor base 37 together. Although securement 1210 may be formed from a conductive material so that it may function as an anode, the innermost anode seen by the microelectronic workpiece under process is preferably a virtual anode corresponding to the interior most anode 1015.

Figure 8:
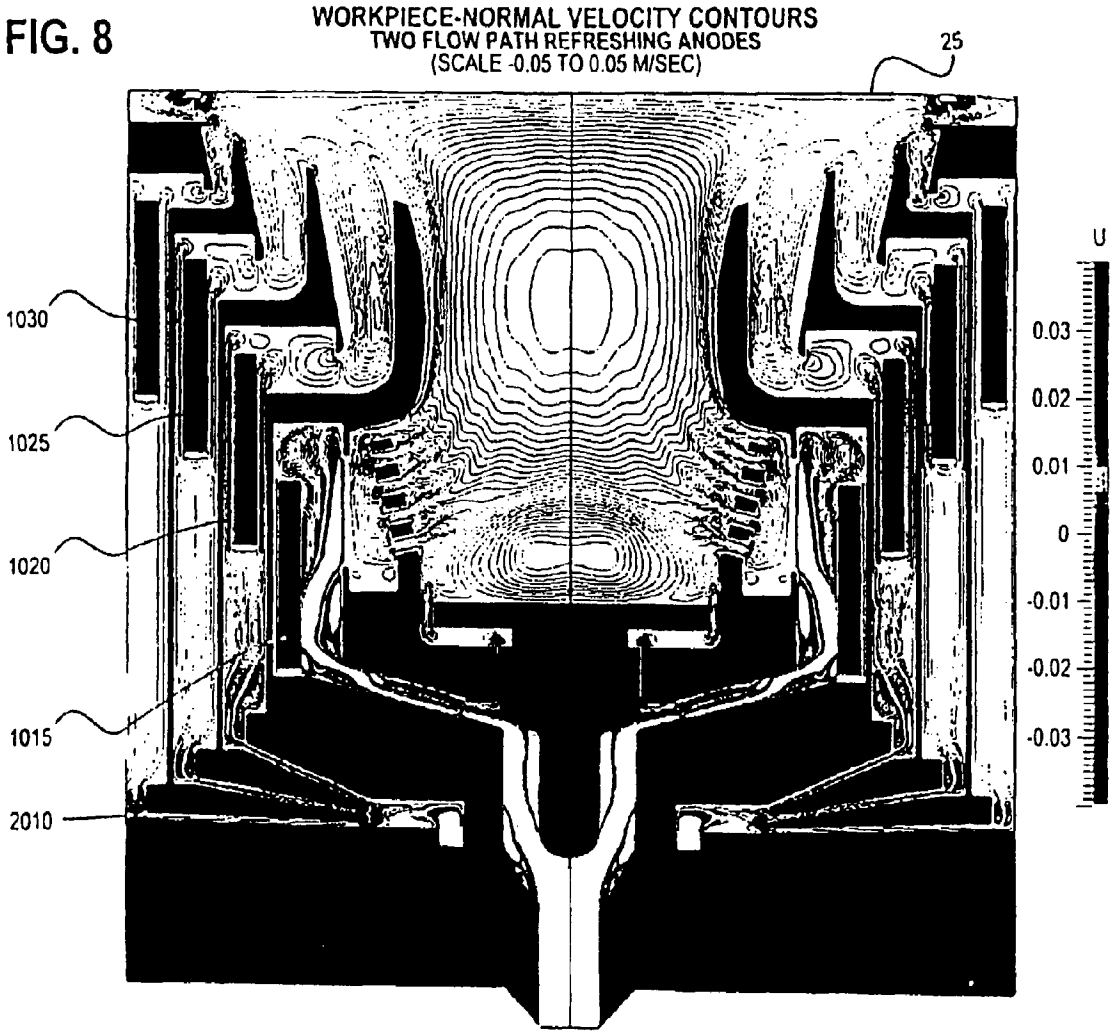
FIGS. 8 and 9 are a cross-sectional views of illustrative velocity flow contours of the processing chamber embodiment of FIGS. 6 and 7.
Figure 9:
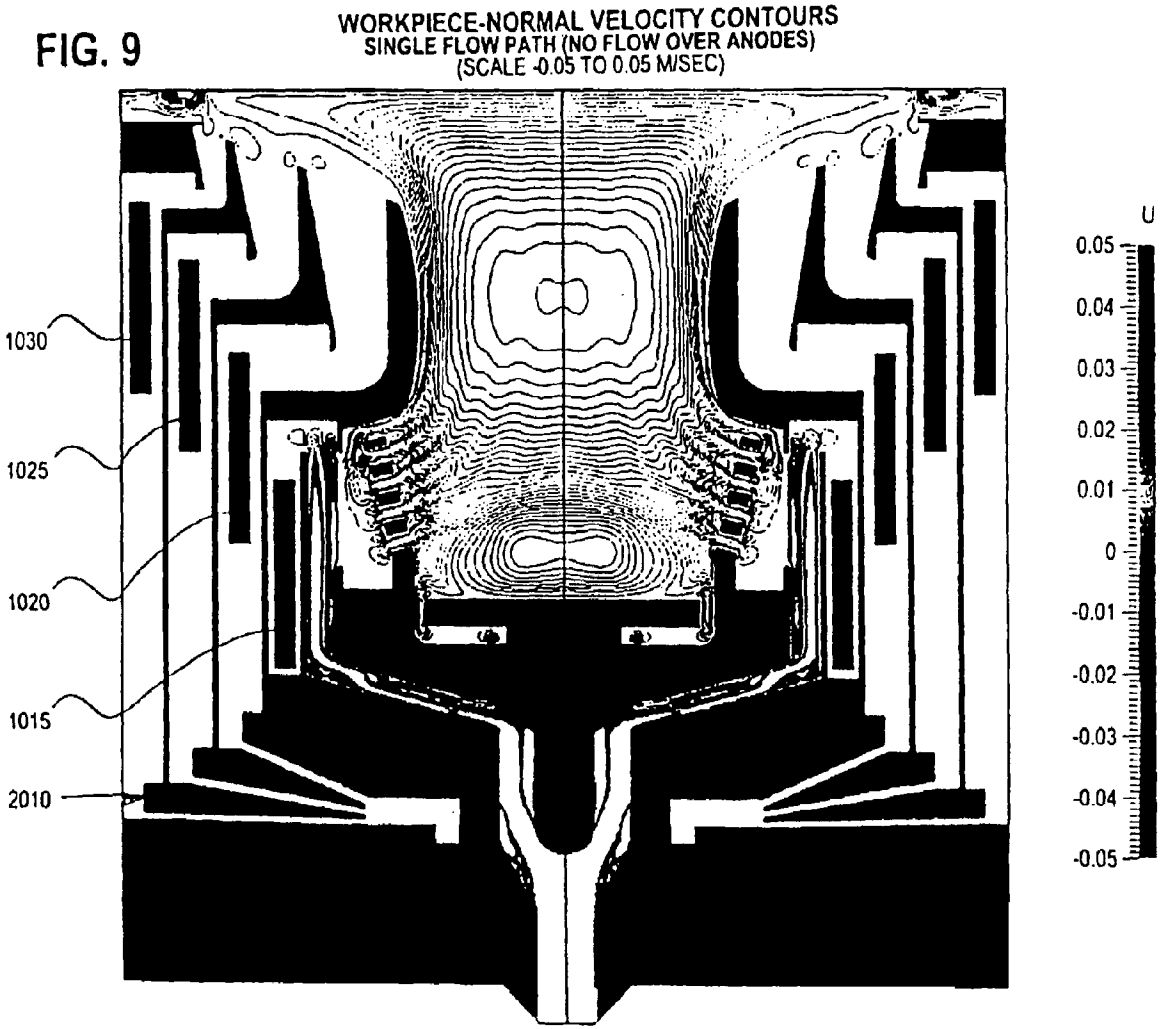
Figure 12:
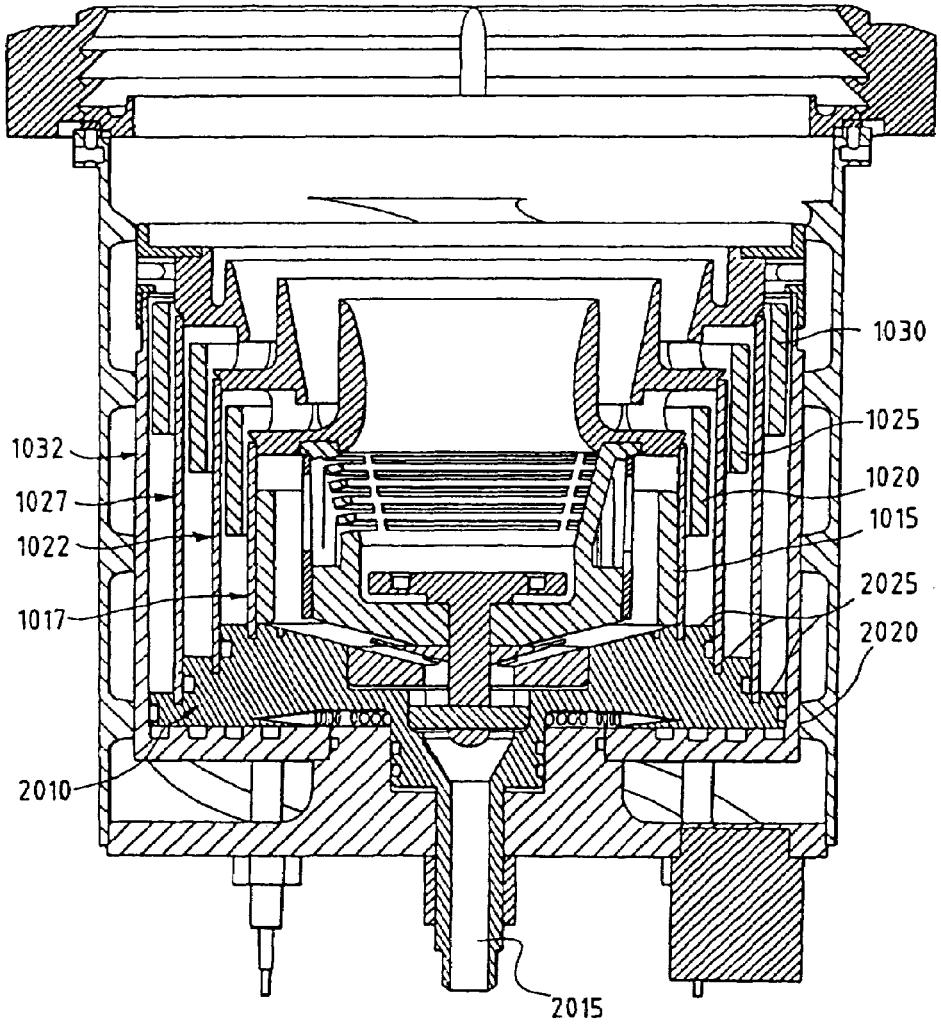
FIGS. 12 and 13 illustrate a modified version of the processing chamber of FIGS. 6 and 7.

FIGS. 8 and 9 illustrate computer simulations of fluid flow velocity contours of a reactor constructed in accordance with the embodiment shown in FIGS. 10 through 12. In this embodiment, all of the anodes of the reactor base may be isolated from a flow of fluid through the anode chamber housings. To this end, FIG. 8 illustrates the fluid flow velocity contours that occur when a floss of electroplating solution is provided through each of the anode chamber housings, while FIG. 9 illustrates the fluid flow velocity contours that occur when there is no flow of electroplating solution provided through the anode chamber housings past the anodes. This latter condition can be accomplished in the reactor of by turning off the flow the flow from the second fluid flow inlet (described below) and may likewise be accomplished in the reactor of FIGS. 6 and 7 by turning of the fluid flow through inlet 1060. Such a condition may be desirable in those instances in which a flow of electroplating solution across the surface of the anodes is found to significantly reduce the organic additive concentration of the solution.

FIG. 12 illustrates a variation of the reactor embodiment shown in FIG. 7. For the sake of simplicity, only the elements pertinent to the following discussion are provided with reference numerals.

This further embodiment employs a different structure for providing fluid flow to the anodes 1015, 1020, 1025 and 1030. More particularly, the further embodiment employs an inlet member 2010 that serves as an inlet for the supply and distribution of the processing fluid to the anode chamber housings 1017, 1022, 1027 and 1032.

Figure 13:
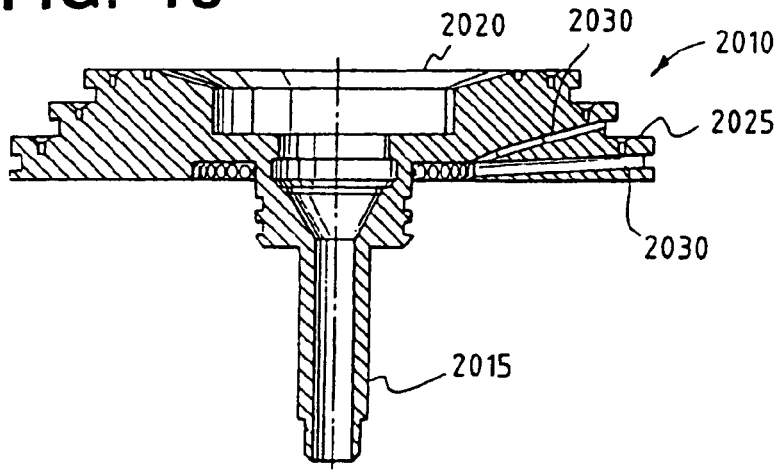

With reference to FIGS. 12 and 13, the inlet member 2010 includes a hollow stem 2015 that may be used to provide a flow of electroplating fluid. The hollow stem 2015 terminates at a stepped hub 2020. Stepped hub 2020 includes a plurality of steps 2025 that each include a groove dimensioned to receive and support a corresponding wall of the anode chamber housings. Processing fluid is directed into the anode chamber housings through a plurality of channels 2030 that proceed from a manifold area into the respective anode chamber housing.

This latter inlet arrangement assists in further electrically isolating anodes 1015, 1020, 1025 and 1030 from one another. Such electrical isolation occurs due to the increased resistance of the electrical flow path between the anodes. The increased resistance is a direct result of the increased length of the fluid flow paths that exist between the anode chamber housings.

The manner in which the electroplating power is supplied to the microelectronic workpiece at the peripheral edge thereof effects the overall film quality of the deposited metal. Some of the more desirable characteristics of a contact assembly used to provide such electroplating power include, for example, the following:

- uniform distribution of electroplating power about the periphery of the microelectronic workpiece to maximize the uniformity of the deposited film;
- consistent contact characteristics to insure wafer-to-wafer uniformity;
- minimal intrusion of the contact assembly on the microelectronic workpiece periphery to maximize the available area for device production; and
- minimal plating on the barrier layer about the microelectronic workpiece periphery to inhibit peeling and/or flaking.

To meet one or more, of the foregoing characteristics, reactor assembly 20 preferably employs a contact assembly 85 that provides either a continuous electrical contact or a high number of discrete electrical contacts with the microelectronic workpiece 25. By providing a more continuous contact with the outer peripheral edges of the microelectronic workpiece 25, in this case around the outer circumference of the semiconductor wafer, a more uniform current is supplied to the microelectronic workpiece 25 that promotes more uniform current densities. The more uniform current densities enhance uniformity in the depth of the deposited material.

Contact assembly 85, in accordance with a preferred embodiment, includes contact members that provide minimal intrusion about the microelectronic workpiece periphery while concurrently providing consistent contact with the seed layer. Contact with the seed layer is enhanced by using a contact member structure that provides a wiping action against the seed layer as the microelectronic workpiece is brought into engagement with the contact assembly. This wiping action assists in removing any oxides at the seed layer surface thereby enhancing the electrical contact between the contact structure and the seed layer. As a result, uniformity of the current densities about the microelectronic workpiece periphery are increased and the resulting film is more uniform. Further, such consistency in the electrical contact facilitates greater consistency in the electroplating process from wafer-to-wafer thereby increasing wafer-to-wafer uniformity.

Contact assembly 85, as will be set forth in further detail below, also preferably includes one or more structures that provide a barrier, individually or in cooperation with other structures that separates the contact/contacts, the peripheral edge portions and backside of the microelectronic workpiece 25 from the plating solution. This prevents the plating of metal onto the individual contacts and, further, assists in preventing any exposed portions of the barrier layer near the edge of the microelectronic workpiece 25 from being exposed to the electroplating environment. As a result, plating of the barrier layer and the appertaining potential for contamination due to flaking of any loosely adhered electroplated material is substantially limited. Exemplary contact assemblies suitable for use in the present system are illustrated in U.S. Ser. No. 09/113,723, while Jul. 10, 1998, entitled "PLATING APPARATUS WITH PLATING CONTACT WITH PERIPHERAL SEAL MEMBER", which is hereby incorporated by reference.

Figure 14:
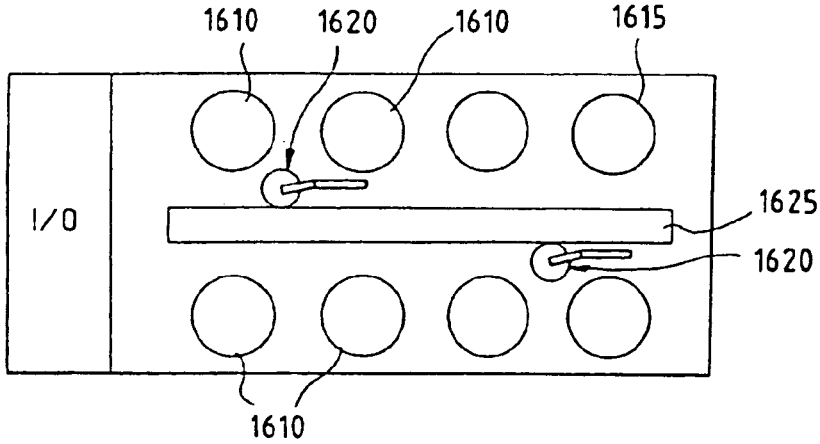
FIGS. 14 and 15 illustrate two embodiments of processing tools that may incorporate one or more processing stations constructed in accordance with the teachings of the present invention.
Figure 15:
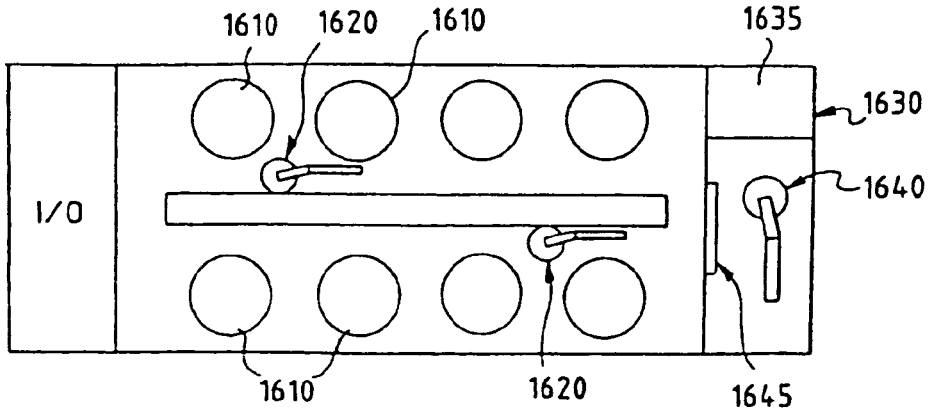

One or more of the foregoing reactor assemblies may be readily integrated in a processing tool that is capable of executing a plurality of processes on a workpiece, such as a semiconductor microelectronic workpiece. One such processing tool is the LT-210™ electroplating apparatus available from Semitool, Inc., of Kalispell, Mont. FIGS. 14 and 15 illustrate such integration.

The system of FIG. 14 includes a plurality of processing stations 1610. Preferably, these processing stations include one or more rinsing/drying stations and one or more electroplating stations (including one or more electroplating reactors such as the one above), although further immersion-chemical processing stations constructed in accordance with the of the present invention may also be employed. The system also preferably includes a thermal processing station, such as at 1615, that includes at least one thermal reactor that is adapted for rapid thermal processing (RTP).

The workpieces are transferred between the processing stations 1610 and the RTP station 1615 using one or more robotic transfer mechanisms 1620 that are disposed for linear movement along a central track 1625. One or more of the stations-1610 may also incorporate structures that are adapted for executing an in-situ rinse. Preferably, all of the processing stations as well as the robotic transfer mechanisms are disposed in a cabinet that is provided with filtered air at a positive pressure to thereby limit airborne contaminants that may reduce the effectiveness of the microelectronic workpiece processing.

FIG. 15 illustrates a further embodiment of a processing tool in which an RTP station 1635, located in portion 1630, that includes at least one thermal reactor, may be integrated in a tool set. Unlike the embodiment of FIG. 14, in this embodiment, at least one thermal reactor is serviced by a dedicated robotic mechanism 1640. The dedicated robotic mechanism 1640 accepts workpieces that are transferred to it by the robotic transfer mechanisms 1620. Transfer may take place through an intermediate staging door/area 1645. As such, it becomes possible to hygienically separate the RTP portion 1630 of the processing tool from other portions of the tool. Additionally, using such a construction, the illustrated annealing station may be implemented as a separate module that is attached to upgrade an existing tool set. It will be recognized that other types of processing stations may be located in portion 1630 in addition to or instead of RTP station 1635.

Numerous modifications may be made to the foregoing system without departing from the basic teachings thereof. Although the present invention has been described in substantial detail with reference to one or more specific embodiments, those of skill in the art will recognize that changes may be made thereto without departing from the scope and spirit of the invention as set forth herein.

We claim:

1. An apparatus for electrochemically processing a surface of a substrate, comprising:

a substrate holder;

a processing chamber adapted to hold an electrolyte and including a principal fluid flow chamber providing a flow of electrolyte processing fluid to at least one surface of the substrate, and a plurality of nozzles providing a flow of electrolyte processing fluid to the principal fluid flow chamber, the plurality of nozzles arranged and directed to provide both radial and vertical fluid flow of electrolyte processing fluid;

a plurality of independently operable concentric electrodes in the processing chamber with the electrodes in electrical contact with an electrolyte provided into the chamber;

an electrical field shield having an annulus between the substrate holder and the concentric electrodes, with the annulus configured to shape an electric field at a peripheral portion of the substrate during electrochemical processing of the substrate surface, the electrical field shield comprising a weir member at an upper portion of the processing chamber, the weir member having a flange that extends radially inwardly to form the annulus.

2. The apparatus of claim 1 wherein the processing chamber comprises an electrode support adapted to mechanically support and electrically isolate the plurality of independently operable concentric electrodes.

3. The apparatus of claim 2 wherein the electrode support comprises a central opening providing a fluid flow path to the principal fluid flow chamber.

4. An apparatus for electrochemically processing a substrate, comprising:

a substrate holder;

a processing chamber adapted to hold an electrolyte;

a plurality of independently operable concentric electrodes in the processing chamber for electrical contact with the electrolyte, with at least two of the electrodes at different elevations within the processing chamber, and with the processing chamber including an electrode support adapted to mechanically support and electrically isolate the plurality of independently operable concentric electrodes; and an electrical field shield having an annulus between the substrate holder and the concentric electrodes, with the annulus configured to shape an electric field at a peripheral portion of the substrate during electrochemical processing of the substrate surface.

5. The apparatus of claim 4 wherein the electrical field shield comprises a weir at an upper portion of the processing chamber, with the weir having a flange extending radially inwardly to form the annulus.

6. The apparatus of claim 5 wherein the weir member is removable from the processing chamber.

7. The apparatus of claim 4 further comprising a drive for moving the substrate holder between at least a first position in which a substrate can be mounted upon or removed from the substrate holder and a second position in which at least one surface of the substrate is positioned for contact with the electrolyte.

8. The apparatus of claim 4 wherein the processing chamber comprises:

a principal fluid flow chamber providing a flow of electrolyte to at least one surface of the substrate; and a plurality of nozzles configured to provide a flow of electrolyte to the principal fluid flow chamber, the plurality of nozzles arranged and directed to provide both radial and vertical fluid flow of electrolyte.

9. The apparatus of claim 8 wherein the electrode support comprises a central opening providing a fluid flow path to the principal fluid flow chamber.

10. An apparatus for electrochemically processing a surface of a substrate, comprising:

a substrate holder;

a processing chamber adapted to hold a processing fluid and including a principal fluid flow chamber providing a flow of processing fluid to at least one surface of the substrate;

a plurality of nozzles configured to provide a flow of processing fluid to the principal fluid flow chamber, the plurality of nozzles arranged and directed to provide both radial and vertical flow of processing fluid;

first, second, and third independently operable concentric electrodes in the processing chamber and in electrical contact with the processing fluid;

an electrical field shield having an annulus between the substrate holder and the concentric electrodes, wherein the annulus is configured to shape an electric field at a peripheral portion of the substrate during electrochemical processing of the substrate surface.

11. The apparatus of claim 10 wherein the electric field shield comprises a weir member at an upper portion of the processing chamber, with the weir having a flange extending radially inwardly to form the annulus.

12. The apparatus of claim 11 wherein the weir member is removable from the processing chamber.

13. The apparatus of claim 10 with at least two of the electrodes at different elevations within the processing chamber.

14. The apparatus of claim 10 further comprising a drive for moving the substrate holder between at least a first position in which a substrate can be mounted upon or removed from the substrate holder and a second position in which at least one surface of the substrate is positioned for contact with the electrolyte.

15. The apparatus of claim 10 further comprising first, second, and third dielectric members above the first, second, and third electrodes, respectively.

16. The apparatus of claim 10 wherein the processing chamber comprises an electrode support adapted to mechanically support and electrically isolate the plurality of independently operable concentric electrodes.

17. The apparatus of claim 16 wherein the electrode support comprises a central opening providing a fluid flow path to the principal fluid flow chamber.

18. An apparatus for electrochemical processing workpieces, comprising:

a head assembly having a workpiece holder configured to carry a workpiece and contact assembly including a plurality of contacts arranged to contact a perimeter portion of the workpiece;

a processing chamber having a central axis and configured to contain a flow of electrochemical processing solution, the processing chamber further comprising a first annular electrode chamber and a second annular electrode chamber concentric with the first electrode chamber;

a first electrode comprising a first circular conductive member in the first annular electrode chamber;

a second electrode comprising a second circular conductive member in the second annular electrode chamber and arranged concentrically with the first electrode;

a field shield between the workpiece holder and at least one of the electrodes, with the field shield comprising a first lateral dielectric member above the first electrode and a second dielectric member above the second electrode, and the field shield aligned with a perimeter portion of the workpiece to electrically shield the perimeter portion of the workpiece from at least one of the electrodes.

19. The apparatus of claim 18 wherein the field shield comprises a horizontal flange extending radially inward over a portion of the outer electrode.

20. The apparatus of claim 18 wherein the first electrode chamber housing is separated from the second electrode chamber by an annular wall.

21. The apparatus of claim 18 further comprising an overflow collector external to the processing chamber to receive processing solution flowing out of the processing chamber.

22. The apparatus of claim 18 further comprising a controller linked to the electrodes and programmed to apply a first current to the first electrode and a second current different than the first current to the second electrode.

23. The apparatus of claim 18 wherein the first and second electrodes are at different elevations within the processing chamber.

24. An apparatus for electrochemical processing of microelectronic workpieces, comprising:

a processing chamber including a first annular electrode chamber and a second annular electrode chamber concentric with the first electrode chamber;

a head assembly having a workpiece holder for holding a workpiece, with the head assembly moveable to place the workpiece holder into the processing chamber;

a plurality of independently operable electrodes in the processing chamber including a first electrode in the first electrode chamber, and a second electrode in the second electrode chamber, with the first electrode concentric with the second electrode;

an annular flange above the second electrode and aligned with a peripheral area of the workpiece holder, wherein the flange extends inwardly to shield a peripheral portion of a workpiece carried by the workpiece holder from the second electrode; and a first dielectric ring projecting over the first electrode chamber to define a first virtual electrode and the annular flange comprising a second dielectric ring projecting over the second electrode chamber to define a second virtual electrode.

25. The apparatus of claim 24 further comprising an overflow collector exterior to the processing chamber to receive processing solution from the processing chamber.

26. The apparatus of claim 24 further comprising a controller operatively coupled to the electrodes, wherein the controller is programmed to apply a first current to the first conductive member and a second current different than the first current to the second conductive member.

* * * * *